US005473818A

United States Patent [19]

Otsuka et al.

[11] Patent Number: 5,473,818

[45] Date of Patent: Dec. 12, 1995

[54] RECIPROCATORY DRY SHAVER

[75] Inventors: Kiyotaka Otsuka, Hikone; Jyuzaemon Iwasaki, Nagahama; Hikoyoshi Nakagawa, Ika, all of Japan

[73] Assignee: Matsushita Electric Works, Ltd., Osaka, Japan

[21] Appl. No.: 155,218

[22] Filed: Nov. 22, 1993

[30] Foreign Application Priority Data

Nov. 25, 1992 [JP] Japan ..... 4-315294
Jan. 26, 1993 [JP] Japan ..... 5-011181

[51] Int. Cl.[6] ..... B26B 19/12

[52] U.S. Cl. ..... 30/43.9; 30/43.7

[58] Field of Search ..... 30/43.92, 43.9, 30/34.1, 43.7

[56] References Cited

U.S. PATENT DOCUMENTS 5,214,833 6/1993 Yada .

FOREIGN PATENT DOCUMENTS 50-3788 5/1975 Japan .
50-3789 5/1975 Japan .
52-92658 4/1977 Japan .
57-53748 11/1982 Japan .
2241744 9/1990 Japan .
629933 9/1949 United Kingdom .
685804 1/1953 United Kingdom .

*Primary Examiner*—Rinaldi I. Rada
*Attorney, Agent, or Firm*—Stevens, Davis, Miller & Mosher

[57] ABSTRACT

A dry shaver includes a perforated outer shearing foil and an inner cutter. The outer shearing foil has a first axis along which it is arcuately curved. The inner cutter has a longitudinal axis along which it is arcuately curved to have an arcuate contour in conformity with the outer shearing foil and is driven to reciprocate in hair shearing engagement with the outer shearing foil. The inner cutter comprises a plurality of inner blades which are spaced along the longitudinal axis in parallel relation to each other, each of the blades having opposed first and second faces each defining a cutting edge at its upper end so that the individual cutting edges are cooperative to define the arcuate contour. Each inner blade, which is offset from a longitudinal center of the inner cutter, is formed with a first face directing outwardly in the offset direction with an undercut immediately adjacent to the cutting edge. The undercut cooperates with the adjacent cutting edge to give an first rake angle β with respect to the vertical plane as well as to give a true rake angle δ with respect to a plane normal to the curvature of the arcuate contour of the inner cutter at the contact between the adjacent cutting edge and the outer shearing foil.

8 Claims, 20 Drawing Sheets

X
Y
Y
X
30
31
32
42
41
40
43
42
52
52
50
51
56
57
55
23
28
27
120
24
27
120
22
29
28
21
25

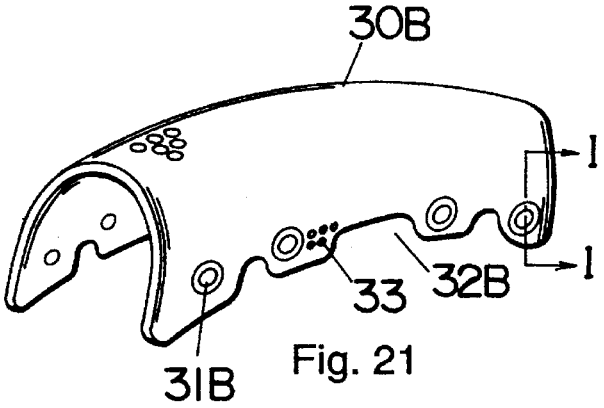
Fig. 21
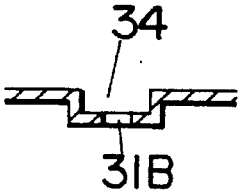
Fig. 22
Fig. 23A
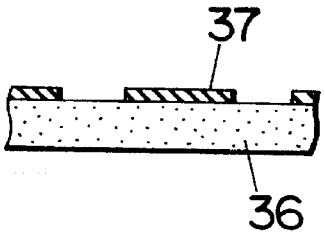
Fig. 23B
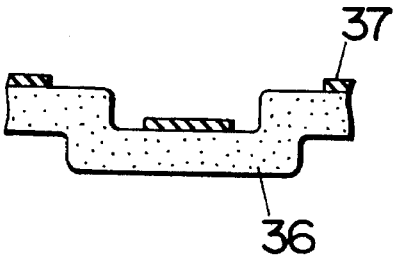
Fig. 23C
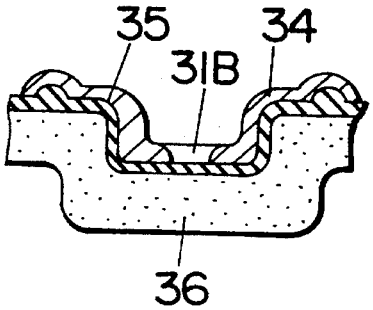
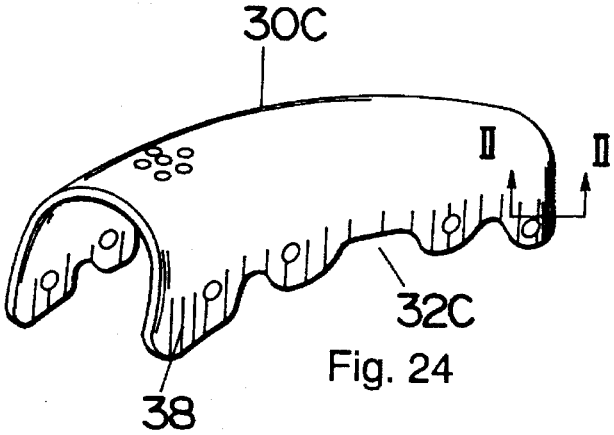
Fig. 24
Fig. 25
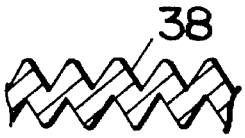

60A
135
163
134
142
61A
16
136
130
62A
15
14A
13
12A
131
140
138
11A

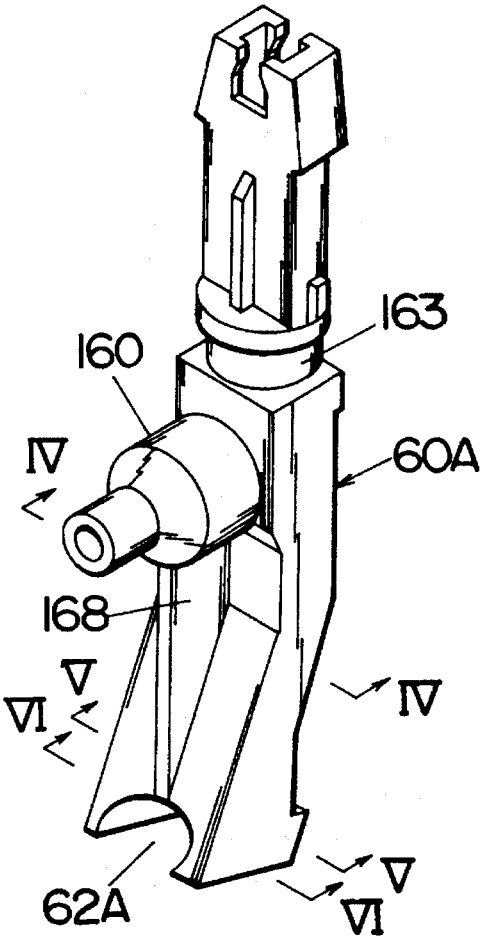
Fig. 30
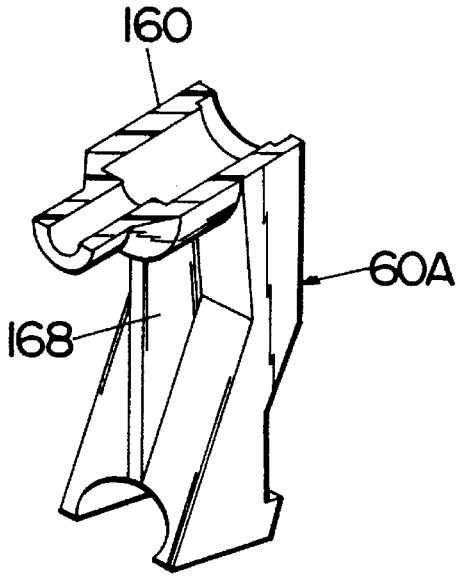
Fig. 31
Fig. 32A
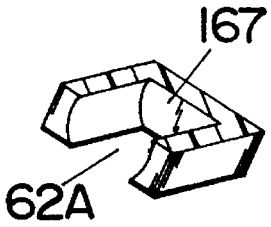
Fig. 32B
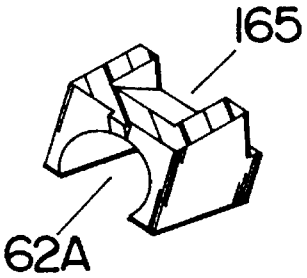

RECIPROCATORY DRY SHAVER

BACKGROUND OF THE INVENTION

1. Field of the Invention

The present invention is directed to a reciprocatory dry shaver, and more particular to a dry shaver having an outer shearing foil curved into an arcuate curvature and an inner cutter reciprocating along an arcuate curvature in hair shearing engagement with the outer shearing foil.

2. Description of the Prior Art

Such dry shavers having an arcuate outer shearing foil and an inner cutter reciprocating along the arcuate curvature of the outer shearing foil have been provided for shaving complicated areas such as chin or underarms, as disclosed in the art, for instance, in JP-A 57-53748, JP-Y2 50-3789, and JP-Y2 50-3788. In the shavers of JP-A 57-53748 and JP-Y2 50-3789, the inner cutter is designed to have a plurality of inner blades mounted on a base in such a manner as to be disposed radially with respect to a center of curvature for the outer shearing foil. However, such radial mounting is rather difficult in assembling the inner cutter, particularly, by molding the blades in the base. In contrast, the shaver of JP-Y2 50-3789 teaches the inner cutter in which a plurality of blades are mounted on a base in parallel relation so that the blades can be readily molded in the base. However, with this parallel mounting in which the blades with opposed parallel vertical faces are spaced along a longitudinal direction of the inner cutter, there arises a problem in that each blade offset longitudinally outwardly from the longitudinal center of the inner cutter forms a cutting angle of more than 90° at one of the opposite faces directed outwardly in the offset direction, while the other face can form a cutting angle of less than 90°, which worsen cutting performance and even brings about undesired dragging of hairs.

SUMMARY OF THE INVENTION

The above problem has been eliminated in the present invention which provides an improved dry shaver in which a plurality of inner blades can be made to form a cutting angle of less than 90° both on opposed faces of each inner blade for assuring sharp cutting performance, while facilitating molding the inner blades in a plastic base member. The dry shaver in accordance with the present invention comprises a perforated outer shearing foil and an inner cutter. The outer shearing foil has a first axis along which it is arcuately curved. The inner cutter has a longitudinal axis along which it is arcuately curved to have an arcuate contour in conformity with the outer shearing foil and is driven to reciprocate in hair shearing engagement with the outer shearing foil. The inner cutter comprises a plurality of inner blades which are spaced along the longitudinal axis in parallel relation to each other. Each blade has opposed first and second vertical faces each defining a cutting edge at its upper end so that the individual cutting edges are cooperative to define the arcuate contour of the inner cutter. Each inner blade, which is offset from a longitudinal center of the inner cutter, is formed in the first face directing outwardly in the offset direction with an undercut immediately adjacent to the cutting edge. The undercut is cooperative with the adjacent cutting edge to give an first rake angle $\beta$ with respect to the vertical plane as well as to give a true rake angle $\delta$ with respect to a plane normal to the curvature of the arcuate contour of the inner cutter at the contact between the adjacent cutting edge and the outer shearing foil. With the provision of the undercut, each of the blades, which is inherently formed at the second face with a cutting angle of less than 90° can be formed also at the first face with a like cutting angle of less than 90°. Accordingly, the blades can effect a sharp cut at both of the cutting edges as the inner cutter reciprocates along the curved outer shearing foil, in spite of the fact that the inner blades are arranged parallel to each other. Therefore, the inner cutter can satisfy both the need for a sharp cut and easy molding of the blades in a plastic base member.

Specifically, the inner blade at each of the opposed longitudinal ends of the inner cutter has the first rake angle $\beta$ which is greater than an angular displacement $\alpha$ for the cutting edge of this blade from the longitudinal center of the inner cutter along the arcuate contour of the inner cutter. With this relation $\beta>\alpha$ for the outermost inner blades, all the blade can satisfy the relation and be formed at the individual first faces with the true rake angle $\delta$ with respect to the plane normal to the curvature, which means that the all the blades have the cutting angle of less than 90° as apparent from a relation that cutting angle is $90°-\delta$. Consequently, all the inner blades can be designed to have a common configuration which satisfies the above relation $\beta>\alpha$.

Accordingly, it is another object of the present invention to provide a dry shaver in which the inner cutter can utilize only one type of the inner blade.

In order to smoothly reciprocate the inner cutter in shearing engagement with the outer shearing foil, the inner cutter includes a pair of the additional blades which are disposed longitudinally outwardly of the inner blades, respectively. Each of the additional inner blade has opposed faces each defining a cutting edge at its upper end which is aligned on the arcuate contour, and is formed at one of the opposed faces directing longitudinally outwardly of the inner cutter with a cutting angle of more than 90°. That is, the cutting edge at the longitudinally outwardly directed face of the additional blade is blunted so as not to get entangled with the curved outer shearing foil when the inner cutter reciprocates with this additional blade leading in the reciprocating direction. Consequently, it is possible to smoothly guide the inner cutter while engaging the cutting edge of the inner blades constantly with the outer shearing foil for further sharp cutting quality, which is therefore a further object of the present invention.

In another version of the present invention, the inner cutter comprises a single base and a plurality of carriers each mounting a plurality of inner blades in parallel relations to one another and in upright relation to the carrier. The carriers are arranged side-by-side on the base along an arcuate path corresponding to the curvature for the outer shearing foil so that the inner blades are oriented generally radially from a center of the curvature. With this generally radial arrangement of the inner blades, the individual blades it is easy to have a suitable cutting angle for sharp cutting, while retaining the advantage of the parallel and upright mounting the individual blades on the individual carriers for facilitating the molding of the blades in the carriers. Also with the generally radial arrangement of the inner blades, all the blades can be easily made to have substantially a uniform cutting angle, thereby ensuring uniform sharp cut by all the inner blades for further enhanced cutting efficiency.

The inner blades on each carrier are formed to define an arcuate contour in exact conformity with the curvature for the outer shearing foil. Each inner blade has opposed first and second faces each defining a cutting edge at its upper end and is formed in at least one of the first and second faces with an undercut immediately adjacent to the cutting edge.

The undercut forms an angle with the adjacent cutting edge to give a rake angle, which in turn forms a cutting angle of less than 90° for a sharp cut.

Preferably, for each carrier, the inner blades offset from a longitudinal center of the carrier is formed only in the first face directing outwardly in the offset direction with an undercut immediately adjacent to the cutting edge. The undercut forms with the adjacent cutting edge to give a rake angle, which in turn gives a cutting angle of less than 90° at the first face, while the cutting edge at the second face is given a cutting angle of less than 90° without the undercut.

Further, the blades may be formed both in the first and second faces with the like undercuts so that the inner blades can be mounted on the carriers without caring about the orientation of the undercut for facilitating the assembly of the inner cutter.

These and still other objects and advantageous features of the present invention will become more apparent from the following detailed description of the embodiments of the invention when taken in conjunction with the attached drawings.

BRIEF DESCRIPTION OF THE DRAWINGS

FIG. 21 is a perspective view of a modified outer shearing foil;

FIG. 22 is a sectional view taken along line I—I of FIG. 21;

FIGS. 23A to 23C are sectional views respectively illustrating portions of the outer shearing foil being made by electroforming;

FIG. 24 is a perspective view of another modified outer shearing foil;

FIG. 25 is a sectional view taken along line II—II of FIG. 24;

FIG. 30 is a perspective view of the drive arm;

FIG. 31 is a perspective view of the drive arm with its upper portion removed to show a section taken along line IV—IV of FIG. 30;

FIG. 32A and 32B are perspective views respectively illustrating sections of the drive arms taken along lines V—V, VI—VI of FIG. 30, respectively.

DETAILED DESCRIPTION OF THE EMBODIMENTS

Figure 1:
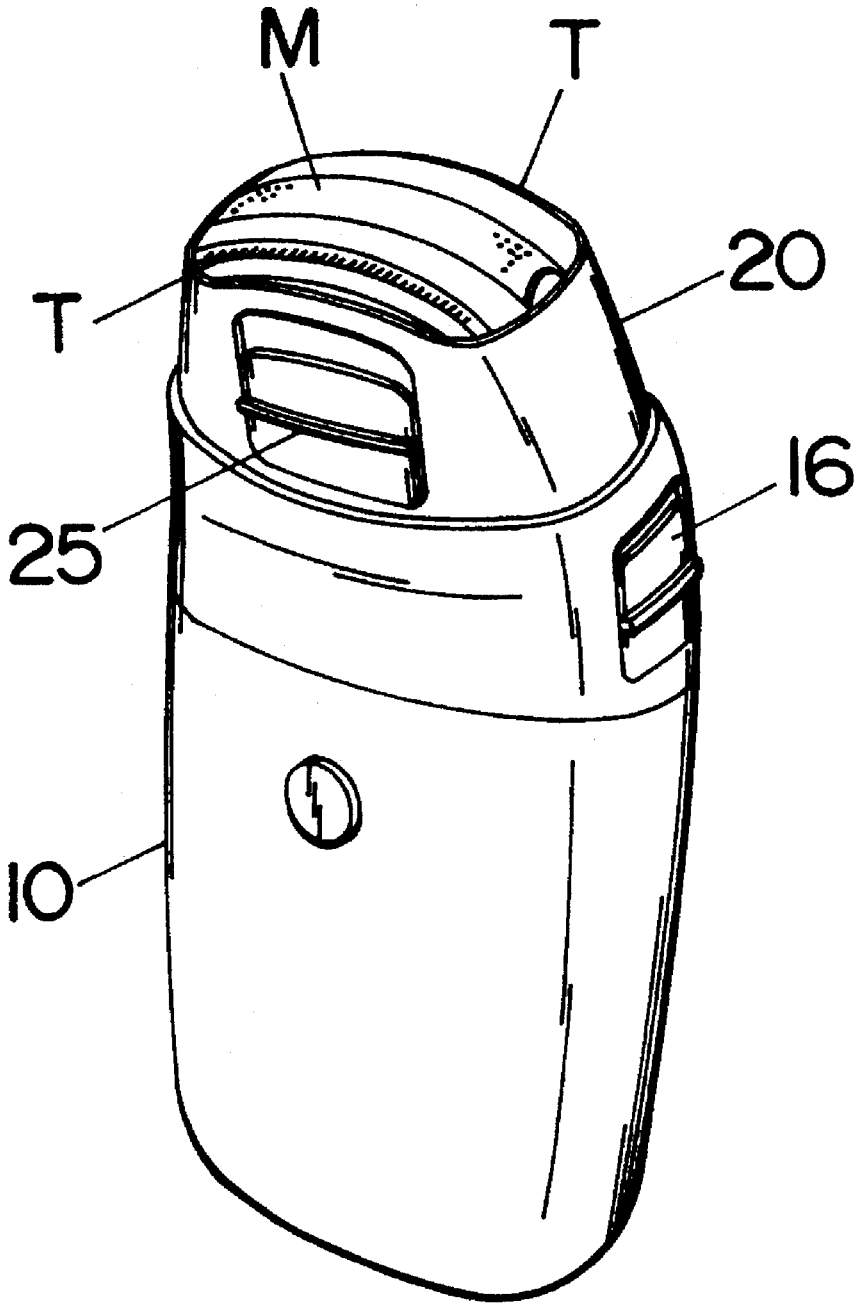
FIG. 1 is a perspective view of a dry shaver in accordance with a first embodiment of the present invention.
Figure 2:
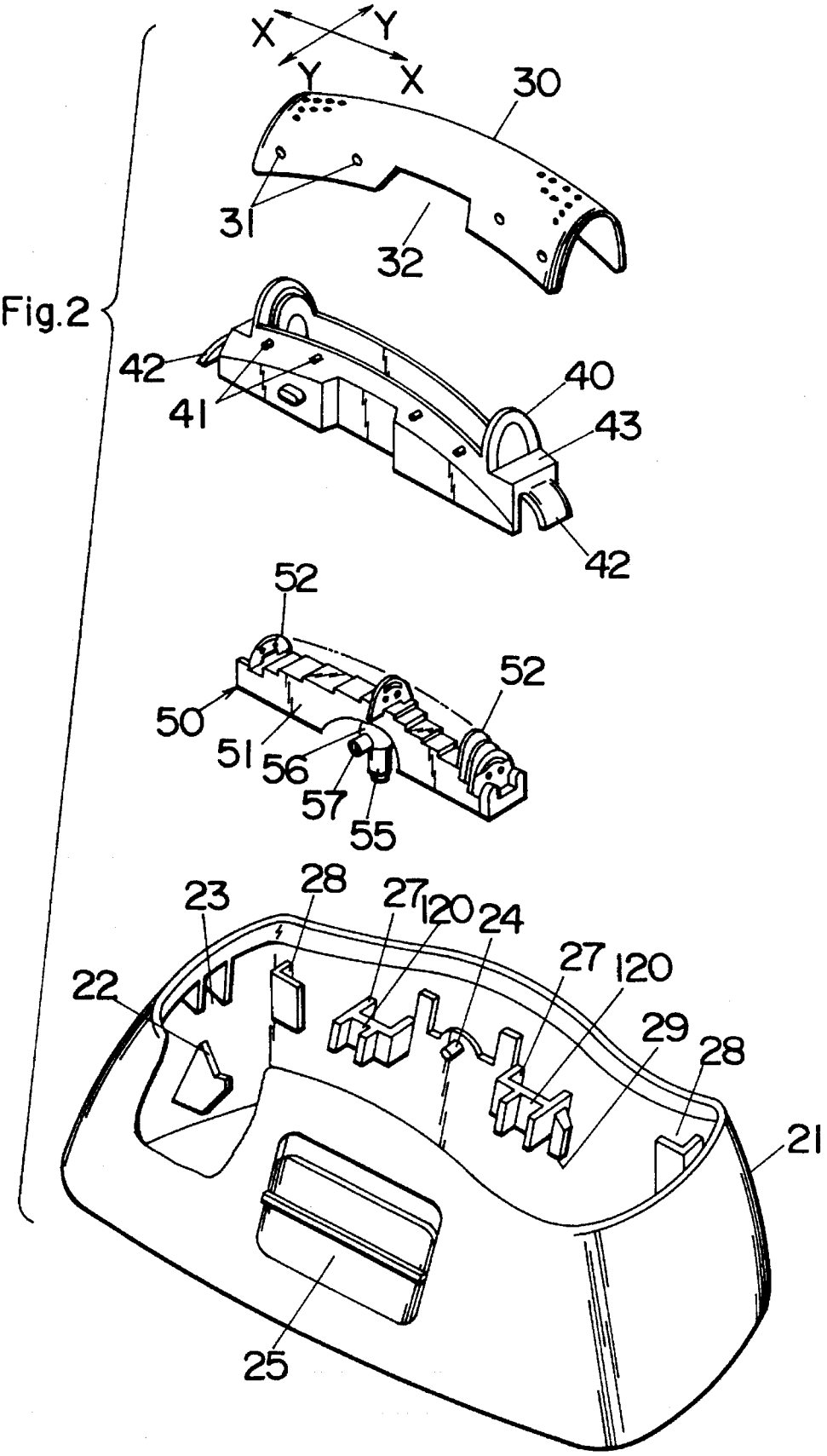
FIG. 2 is an exploded perspective view of a cutter head of the shaver.
Figure 3:
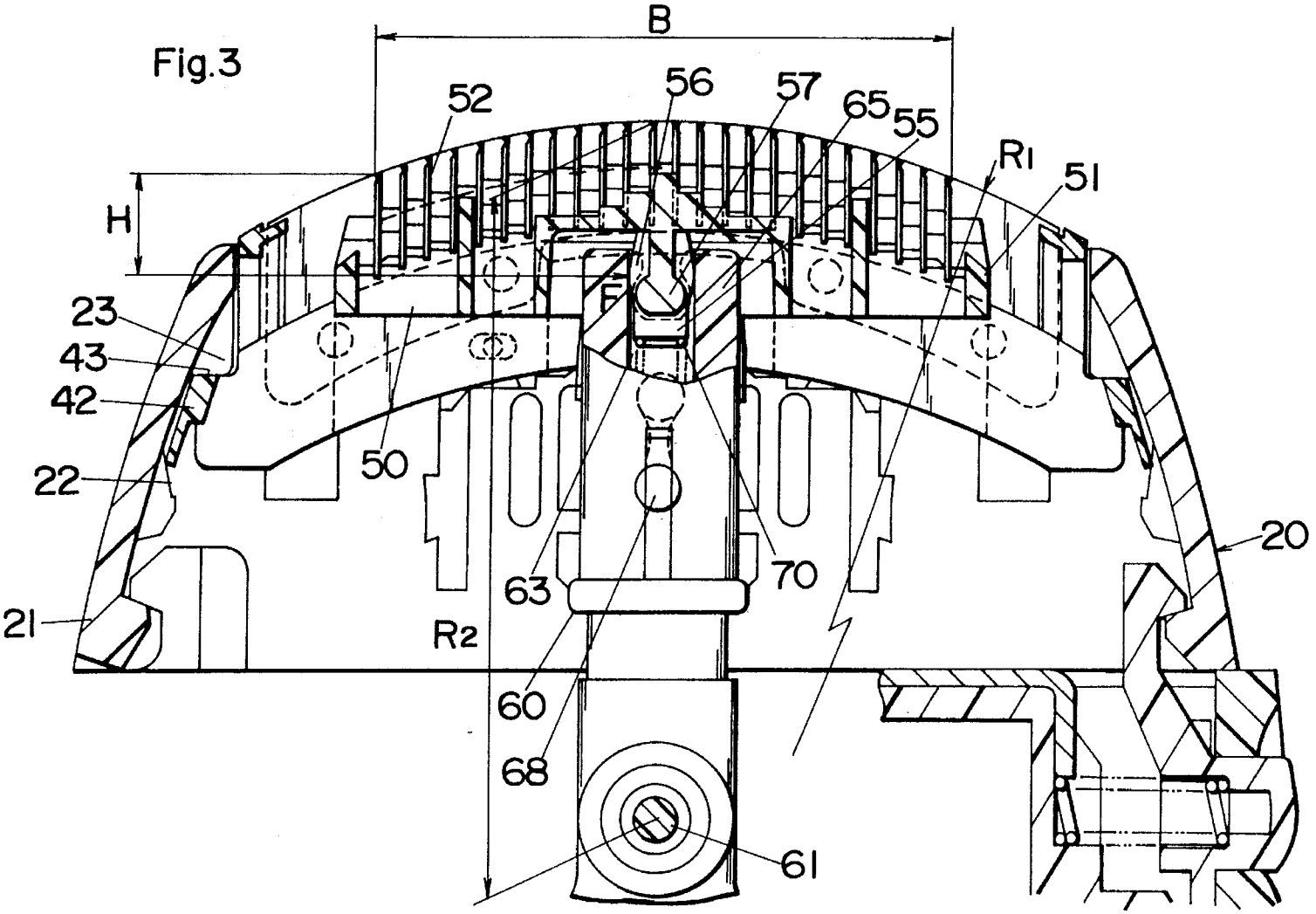
FIG. 3 is a front sectional view of the cutter head.
Figure 4:
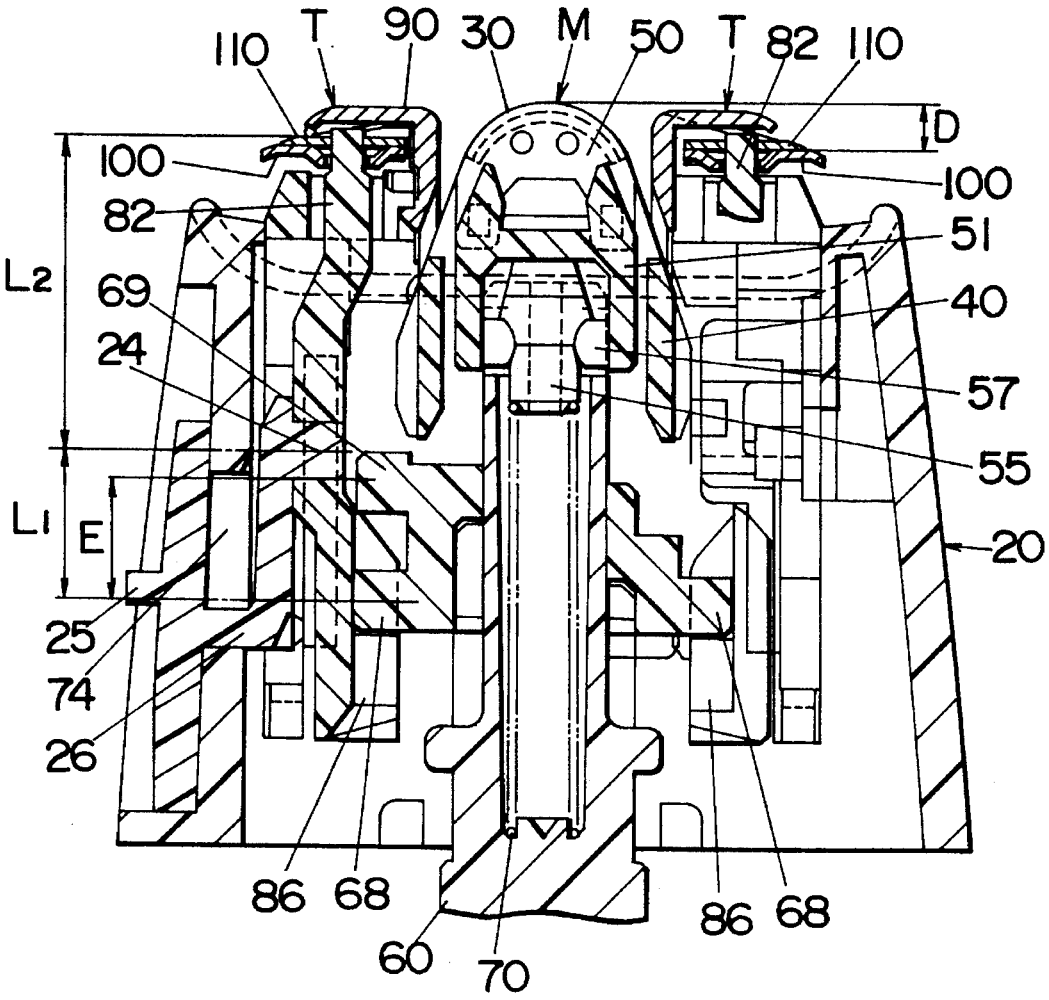
FIG. 4 is a side sectional view of the cutter head.

Referring now to FIG. 1, there is shown a dry shaver in accordance with a first embodiment of the present invention. The shaver comprises a housing 10 mounting thereon a detachable cutter head 20 which includes a main cutter M and a pair of trimmers T. As shown in FIGS. 2 to 4, the main cutter M comprises an outer shearing foil 30 with a number of perforations and an inner cutter 50. The trimmers T are each configured to comprise a toothed stationary blade 100 and a toothed movable blade 110. A drive arm 60 projects from the housing 10 into the cutter head 20 and connected to reciprocate the inner cutter 40 as well as the movable blades 110 in hair shearing engagement respectively with the outer shearing foil 30 and the stationary blades 100. The housing 10 incorporates an electric motor 11 which is connected to the drive arm 60 through a rotary-to-oscillatory conversion mechanism for reciprocating the inner cutter 50 and the blades 110.

As shown in FIG. 2, the cutter head 20 comprises a top-opened generally rectangular head frame 21 mounting a plastic holder 40 for the outer shearing foil 30 and the trimmers T on the opposite sides thereof. The outer shearing foil 30 is arcuately curved along its longitudinal axis X in addition to along an axis Y perpendicular to the longitudinal axis X but with differing curvatures so that the outer shearing foil 30 has along the X-axis an arcuate cross section of larger radius of curvature than an arcuate cross section along the Y-axis. The holder 40 is formed on its side walls with a plurality of studs 41 which are longitudinally spaced along an arcuate path and engage into corresponding holes 31 in the lateral sides of the outer shearing foil 30, respectively, to support the arcuately curved outer shearing foil 30. The studs 41 on the longitudinal ends of the holder 40 are swelled by application of heat so as to be fixed to the corresponding holes 31, while the remaining center studs 41 are left unfixed in order that the outer shearing foil 30 is kept to have a uniform radius $R_1$ of curvature. For the same purpose, the outer shearing foil 30 is formed in the center of the lateral sides with cut-outs 32. Formed at the longitudinal ends of the holder 40 are resilient legs 42 which depend downwardly and outwardly and abut at the respective lower ends against cam surfaces of projections 22 on the interior of the head frame 20, as best shown in FIG. 3, in such a manner that the holder 40 is urged upwardly to a position where shoulders 43 formed adjacently of the upper end of the legs 42 are seated against corresponding stops 23 formed on the interior of the head frame 21 upwardly of the projection 22. Thus, the holder 40 can be readily assembled into the head frame 21 through a bottom opening of the head frame 21 and is floatingly supported thereby by the resiliency of the legs 42.

Figure 5:
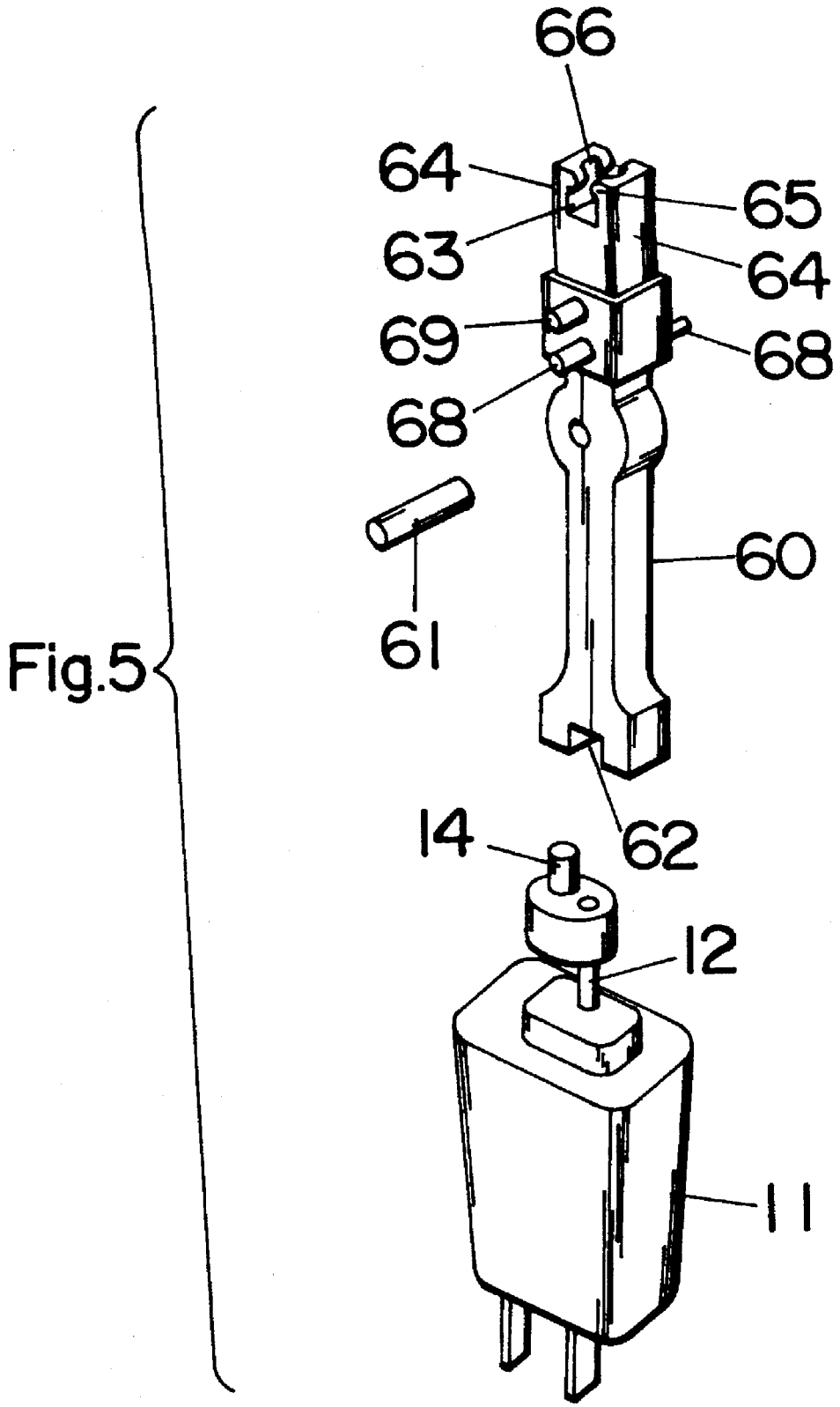
FIG. 5 is an exploded perspective view illustrating a drive arm and a motor utilized in the dry shaver for reciprocating an inner cutter of the cutter head.

The inner cutter 50 comprises a rectangular base 51 on which a plurality of blades 52 are mounted as being evenly spaced longitudinally. Each blade 52 has an arcuate edge in conformity with the curvature of the outer shearing foil 30 along the Y-axis, while the blades 52 are arranged such that the arcuate edges thereof defines an arcuate contour in conformity with the curvature of the outer shearing foil 30 along the X-axis. Thus constructed inner cutter 50 is driven by the drive arm 60 to reciprocate along the X-axis in hair shearing engagement between the blades 52 and the outer shearing foil 30. As shown in FIGS. 3 and 5, the drive arm 60 is pivotally supported at an intermediate portion to the housing 10 by means of a pivot pin 61 and is coupled to the inner cutter 50 at its upper ends and coupled to an eccentric pin 14 of the motor 11 at its lower end. The eccentric pin 14 is coupled to an output shaft 12 of the motor 11 in an eccentric relation and is engaged into a slot 62 in the lower end of the drive arm 60 so that the drive arm 60 pivots about the pin 61 as the motor 11 is energized to rotate the eccentric pin 14 about the output shaft 12. Formed in the upper end of drive arm 60 is a longitudinally extending groove 63 which defines a pair of jaws 64 on the opposite sides thereof. Formed respectively at the upper end of the jaws 64 are lips 65 which extends inwardly toward to each other to define therebetween a constricted opening 66 and which are each formed in its center with a recess 67. The drive arm 60 is also formed with a pair of first pins 68 projecting coaxially and parallel with the pivot pin 61 on the opposite faces of the arm 60 and with a second pin 69 projecting on the one face of the arm 60 in parallel with and upwardly of the first pin 68.

Figure 6:
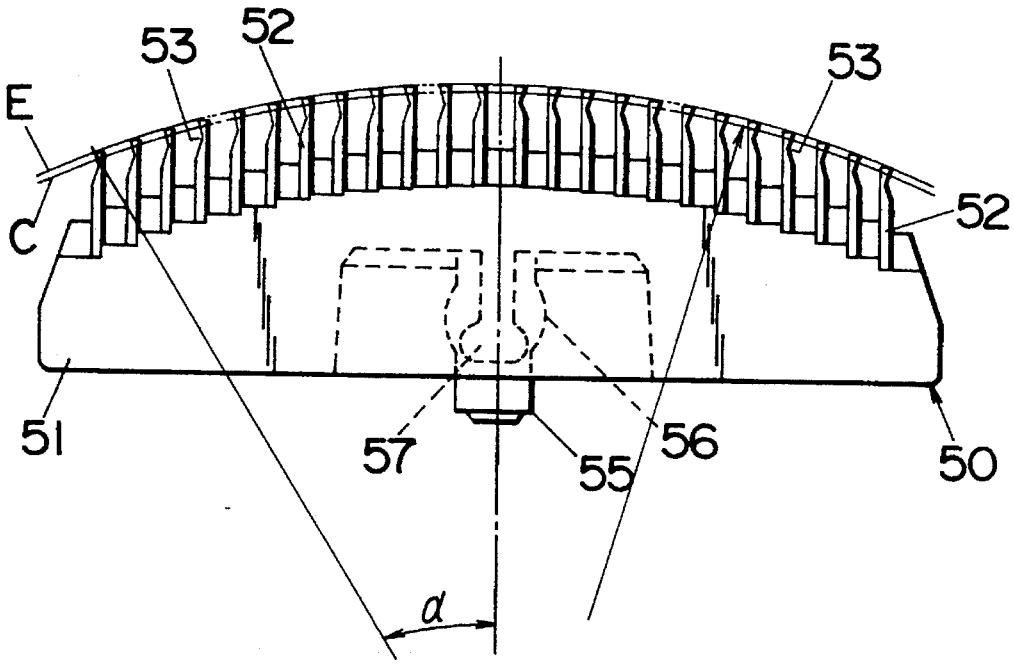
FIG. 6 is a front sectional view of the inner cutter.

As seen in FIGS. 2 and 6, the inner cutter 50 includes a stem 55 which depends downwardly from the center of the base 51 for connection to the drive arm 60. The stem 55 is formed at its upper end with a swell 56 which fits into the recesses 67 of the lips 65 at the upper end of the drive arm 60 after the stem 50 is inserted into the groove 63 of the drive arm 60. Integrally formed with the stem 55 is an axle 57 which projects horizontally along the Y-axis in the opposite directions from a portion just below the swell 56 and which is slidable engaged into the groove 63 so that the inner cutter 50 is slidable along the length of the drive arm 60 within a limited distance. The inner cutter 50 is assembled to the drive arm 60 by forcing the axle 57 into the groove 63 by resiliently flexing the jaws 54 outwardly, after which the jaws 54 close so that the axle 57 is retained in the groove 63 by engagement of the axles 57 to the lower end of the lips 65. A coil spring 70 is fitted in the groove 63 as being compressed between the bottom of the groove 63 and the lower end of the stem 55 so that the inner cutter 50 is urged upwardly against the outer shearing foil 30 until the axle 57 engage with the lower end of the lips 65. Thus, the inner cutter 50 is floatingly supported to the drive arm 60 so as to be movable along the longitudinal direction of the drive arm 60, while at the same time the inner cutter 50 is tiltable within a limited angular range within a plane including the X-axis.

The pivot pin 61 of the drive arm 60 is disposed at a position such that, as the drive arm 60 pivots, the upper end of the drive arm 60 traces an arc of a curvature which is spaced by a greater extent to the outer shearing foil 30 when the drive arm 60 moves towards its angularly displaced end positions than at a neutral position of FIG. 3. That is, as the drive arm 60 moves from the neutral position to either of the end positions, the stem 55 of the inner cutter 50 is allowed to move outwardly within the groove 63 by the coil spring 70 with the attendant slackening of the coil spring 70. Whereby, the inner cutter 50 is urged against the outer shearing foil 30 by a bias of the spring 70 which is weaker when the inner cutter 50 moves to the angularly displaced end positions than when the inner cutter 50 is at the neutral position of FIG. 3, in which the axle 57 is depressed into the groove 63 by a largest extent. It should be noted that as the axle 57 move along the groove 63, the swell 56 is kept in contact with the recesses 67 of the lips 65 so that the inner cutter 50 receives at this point of contact from the drive arm 60 a driving force for reciprocation. With this varying biasing force applied to urge the inner cutter 50 against the outer shearing foil 30, the inner cutter 50 is well prevented from jamming with the outer shearing foil 30 because of that even the moving speed of the inner cutter 50 decreases as it advances to either of the opposite end positions, the biasing force is lowered correspondingly but at a level enough to keep the inner cutter in hair shearing contact with the outer shearing foil 30. In other words, the biasing force decreases with the decreasing moving speed of the inner cutter 50 to avoid the jamming of the inner cutter 50 with the outer shearing foil 30, particularly when reaching either of the angularly displaced end positions. As a matter of consequence, the biasing force becomes greatest when the inner cutter 50 is at the neutral position of FIG. 3, at which the moving speed of the inner cutter 50 reaches maximum to compensate for the biasing force in a sense of avoiding the jamming. Further, the inner cutter 50 is made tiltable about the swell 56 within a limited angular range in a plane including the X-axis so that all the blades 52 are kept into close contact with the outer shearing foil 30 while the inner cutter 50 reciprocates along the curvature of the outer shearing foil 30 as being continuously displaced in the longitudinal direction of the drive arm 60. In this manner, smooth shaving is successfully made with the arcuately contoured cutter.

It is noted in this connection that when considering a distance $R_2$ measured from the axis of the pivot pin 61 to an upper end of the blade 52 at the longitudinal center of the inner cutter 50 at its neutral position of FIG. 3, the arcuate contour of the inner cutter 50 would follow an arcuate path having a radius of $R_2$ as the drive arm 60 pivots in the absence of the coil spring 70 urging the inner cutter 50 radially outwardly, and such virtual arcuate path is in parallel with the arcuate path along which the upper end of the drive arm 60 traces. The distance or radius $R_2$ of the virtual curvature is selected to be less than the radius R of curvature for the outer shearing foil 30 and satisfy the following relation:

$$0.5<R_2/R_1(<1)$$

The above relation is found experimentally to be essential for smoothly sliding the inner cutter 50 along the arcuate outer shearing foil 30, particularly, in the direction of moving the inner cutter 50 from the end positions to the neutral position. When $R_2$ is selected to be considerably less than $R_1$, i.e., the upper end of the drive arm 60 traces the correspondingly arcuately path having a radius considerably less than $R_1$, the drive force F acting along a tangent of the correspondingly greater curvature for moving the inner cutter towards the neutral position is also applied to the outer shearing foil 30 at a greater angle, thereby unduly increasing the friction between the inner cutter 50 and the outer shearing foil 30 or even damaging the blades 52 and the foil 30. In order to avoid this problem, experiments have been made with differing ratios of $R_2/R_1$ and reveal that the above relation $R_2/R_1>0.5$ is essential for assuring smooth sliding movement of the inner cutter from the end positions to the neutral position, in addition to the movement from the neutral position to the end positions.

Figure 7:
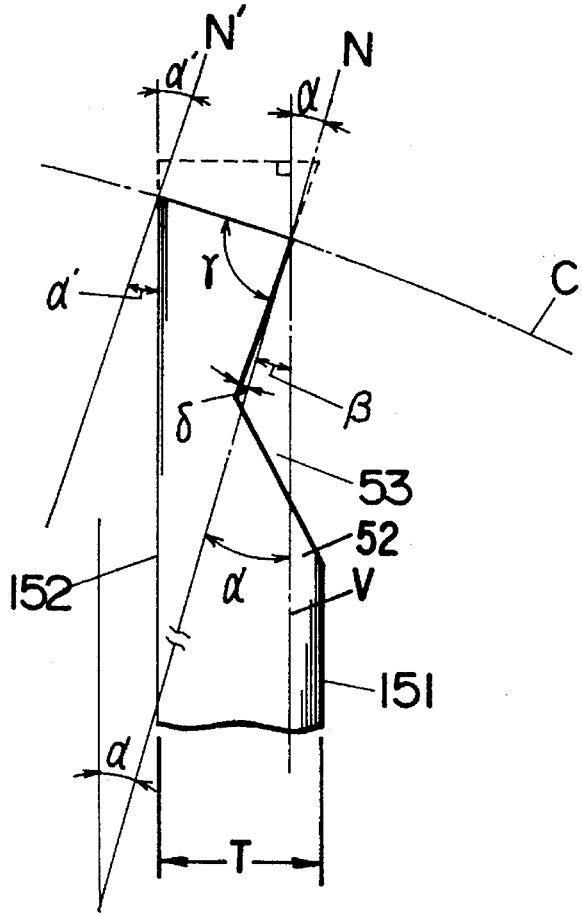
FIG. 7 is an enlarged view of a tip of an inner blade forming the inner cutter.

The inner cutter 50 is fabricated by a known integral molding technique in which the blades 52 are molded into the base 51 of a plastic material in such a manner that the blades 52 are arranged upright and in parallel relation to each other, as shown in FIG. 6. Each of the inner blades 52 has opposite first and second vertical faces 151 and 152. The first and second faces 151 and 152 are cooperative with a top end face of the blade to form respective cutting edges. The inner blades 52 are each formed at a portion immediately below the cutting edge with an undercut 53 and are arranged in such a manner that the blades 52 on either side of the longitudinal center of the inner cutter have the individual undercuts 53 directing longitudinally outwardly of the inner cutter. In other words, the inner blades 52 which are offset from a longitudinal center of the inner cutter have the respective first faces 151 directed longitudinally outwardly in the offset direction and have the undercuts 53 formed respectively in the first faces. Initially, the blades 52 are molded into the base 51 to define an arcuate contour, i.e., an envelop passing through the tips of the blades 52, as indicated by a line E in FIG. 6. Thereafter, the blades 52 are ground along a curvature, as indicated by C in the figure, having a uniform radius $R_1$. The grinding of the blades 52 is made to extend to upper portions of the undercuts 53 but not to the bottoms thereof for removing the upper end of the undercut portion of the blades 52, as shown in FIG. 7. As best shown in FIG. 7, the undercut 53 is formed in the first face immediately adjacent to the cutting edge to form a first rake angle $\beta$ with respect to the vertical plane V or a plane parallel to a general plane of the first face 151 and at the same time to form a true rake angle $\delta$ with respect to a plane N normal to a tangent of the curvature having the radius of $R_1$ at the adjacent cutting edge. Thus, the cutting edge at the first face 151 has a cutting angle of y which is less than 90° [$\gamma=90°-\delta$]. The other cutting edge at the second face 152 which is parallel to the vertical plane forms a true rake angle of $\alpha'$ with respect to a plane normal N' to a tangent of the arcuate contour at the cutting edge. That is, the rake angle $\alpha'$ for the second face 152 is equal to an angular displacement $\alpha'$ of the cutting edge from the longitudinal center of the inner cutter along the arcuate path having the radius $R_1$. Since the thickness T of the blades 52 is sufficiently small relative to the radius $R_1$ of the curvature (in this instance $R_1$=35 mm and T=0.15 mm), the rake angle $\alpha'$ is substantially equal to an angular displacement $\alpha$ of the cutting edge at the first face 151 of the same blade 52 along the curvature. Thus, the second face 152 has a cutting angle which is also less than 90°. Therefore, as the inner cutter 50 reciprocates to move the inner blades 52 in sliding contact with the outer shearing foil 30, the cutting edges on opposite sides of each blade are available for cutting the hairs. It is noted in this connection that, even the blades 52 are disposed upright for ensuring easy fabrication of the inner cutter by molding the blades into the base, each blade 52 can have the cutting angle $\gamma$ of less than 90° with the presence of the undercut 53 in the first face 151 which would otherwise form a cutting angle of more than 90°. The cutting angle $\alpha'$ at the second face 152 is inherently made less than 90° as apparent from the above-described angular displacement of the cutting edge. Consequently, a sharp cut is assured with the inner cutter of this configuration.

Further, all the inner blades 52 are made to have the same undercut 53 which gives the relation that the first rake angle $\beta$ is greater than the angular displacement $\alpha$ of the cutting edge at the first face even for the blade 52 disposed at the longitudinal end of the inner cutter 50, as shown in FIG. 7. In this instance, $\alpha$ is selected to be 22°, $\alpha$ for the outermost blade is 21° and $\alpha$ for the innermost blade is 1°. With this relation $\beta>\alpha$ for the outermost inner blades, all the blade can satisfy the relation and be formed at the individual first faces with the true rake angle $\delta$ (1° to 21°) and therefore with the cutting angle $\gamma$ of less than 90° ($69°<\gamma<90°$). Thus, only one type of the blade is enough for the inner cutter.

Figure 8:
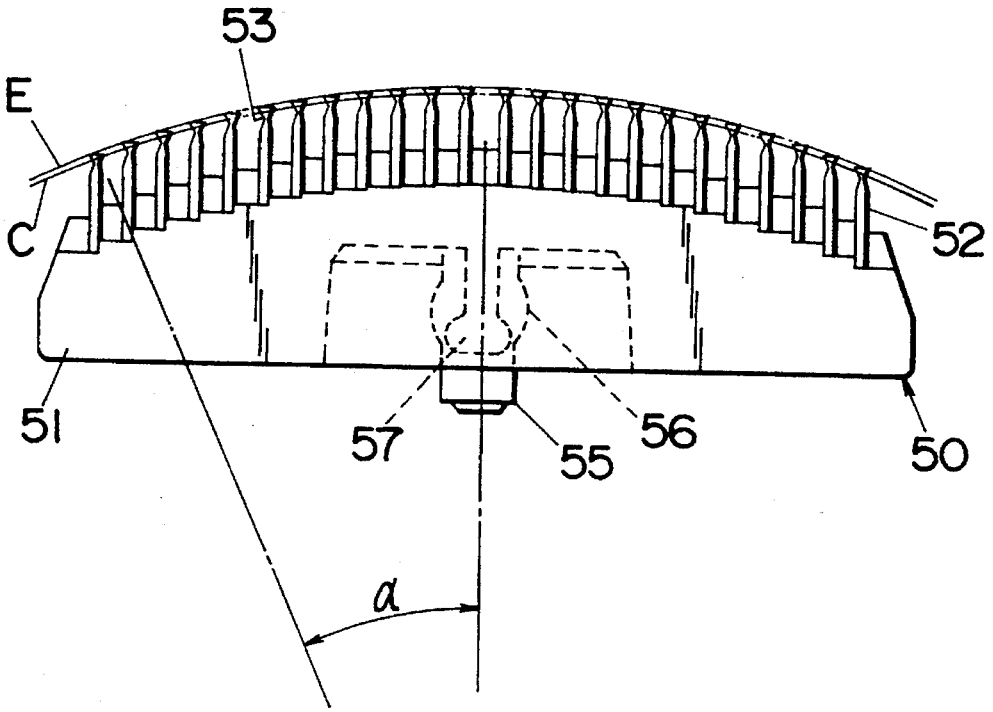
FIG. 8 is a front sectional view of an inner cutter in accordance with a first modification of the embodiment.
Figure 9:
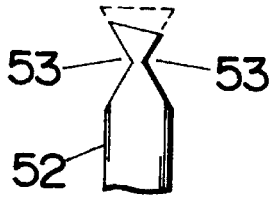
FIG. 9 is an enlarged view of a tip of an inner blade forming the inner cutter of FIG. 8.

FIGS. 8 and 9 show a first modification of the above embodiment in which the undercut 53 is formed also in the second face of each blade 52 in order to give more acute cutting angle for the cutting edge at the second face.

Figure 10:
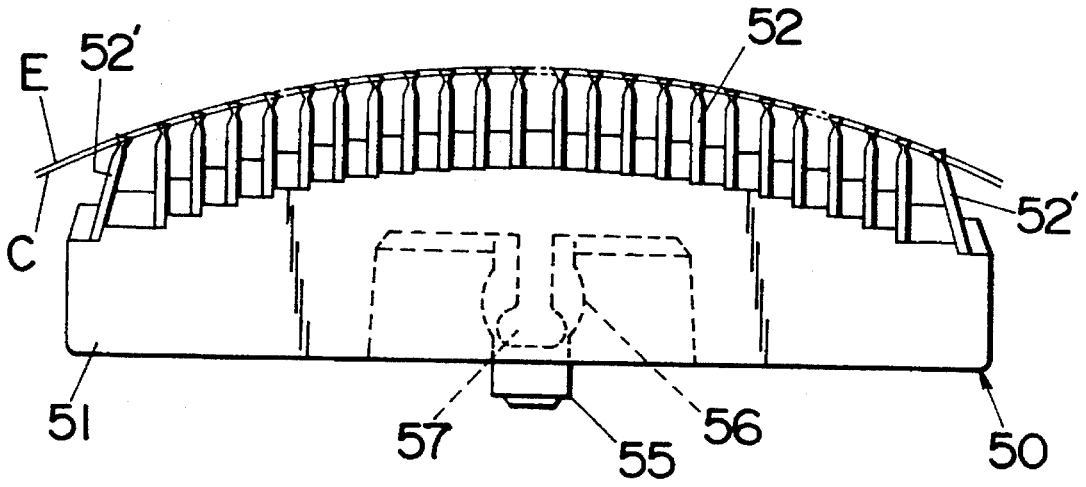
FIG. 10 is a front sectional view of an inner cutter in accordance with a second modification of the embodiment.
Figure 11:
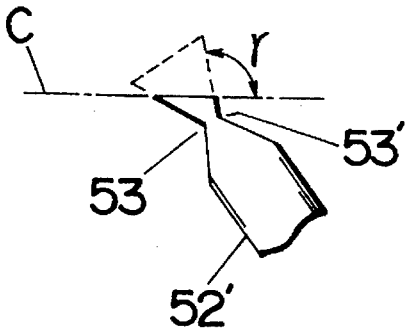
FIG. 11 is an enlarged view of a tip of an inner blade forming the inner cutter of FIG. 10.

FIGS. 10 and 11 show a second modification of the above embodiment in which the undercut 53 is formed also in the second face of each blade 52 and in which an additional blade 52' is provided at each of the opposed longitudinal ends of the inner cutter 50. The additional blade 52'0 is formed both in its opposed faces with like undercuts 53' and is inclined longitudinally inwardly in such a manner as to form at the outwardly directing face a cutting angle of $\gamma$ which is greater than 90° with respect to the plane normal to the curvature of the arcuate contour of the inner cutter. With the provision of a thus blunted cutting edge at the outward face of the additional blade 52', the inner cutter is well prevented from get entangled with the outer shearing foil at its leading end in the moving direction during the reciprocation along the curved outer shearing foil, thereby being smoothly guided in hair shearing engagement with the outer shearing foil.

Figure 12:
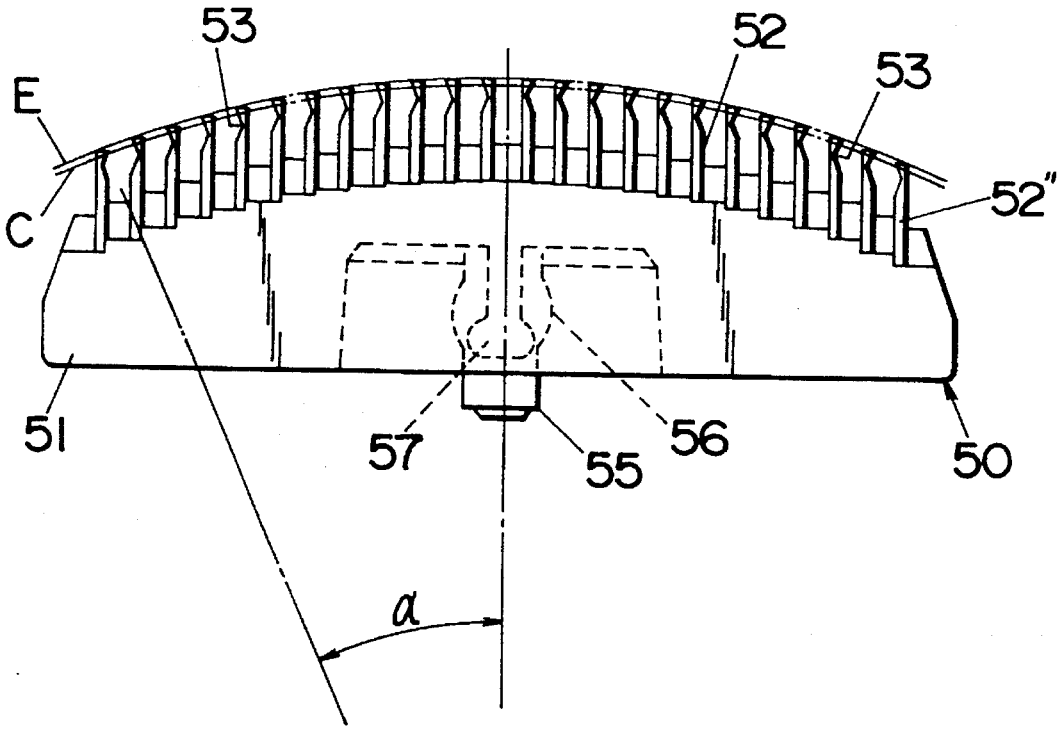
FIG. 12 is a front sectional view of an inner cutter in accordance with a third modification of the embodiment.
Figure 13:
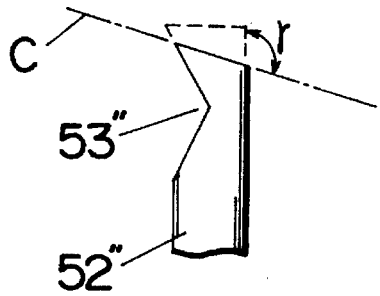
FIG. 13 is an enlarged view of a tip of an inner blade forming the inner cutter of FIG. 12.

Alternatively, as shown in FIGS. 12 and 13, the inner cutter may have additional upright mounted blade 52" without an undercut in the first face or one of the opposed faces directing longitudinally outwardly so as to form at the first face a cutting angle $\gamma$ which is greater than 90°. In the illustrated instance, the additional blade 52" is formed in the second face with a like undercut 53" so as to form at the second face a sharp cutting angle for assuring good cutting efficiency also thereat.

It should be noted that the undercut in the blades and the additional blades extends over a distance along the cutting edge which is in effective hair shearing contact with the outer shearing foil. Accordingly, the undercut is not necessarily formed to extend over the entire distance along the cutting edge.

Figure 14:
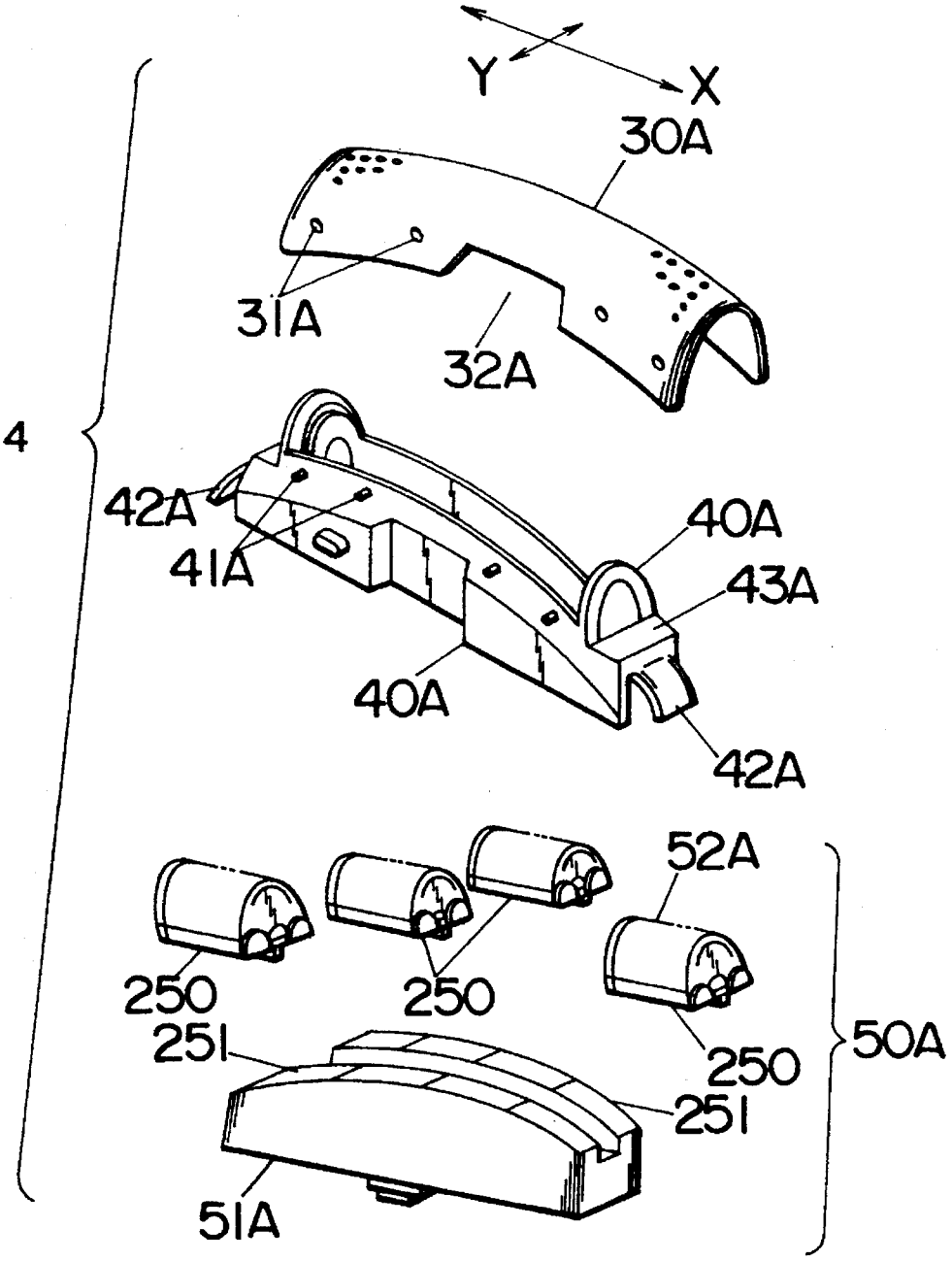
FIG. 14 is an exploded perspective view of a cutter head for a dry shaver in accordance with a second embodiment of the present Invention.
Figure 15:
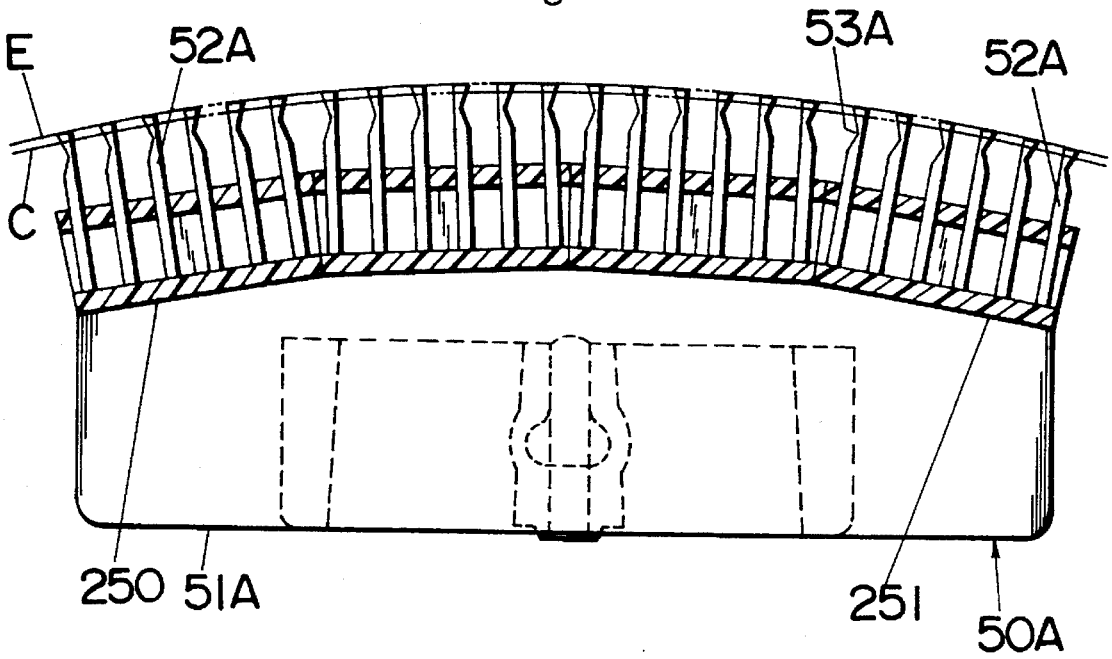
FIGS. 15 and 16 are enlarged front sectional views, respectively of an inner cutter and a carrier utilized in the cutter head of FIG. 14.
Figure 16:
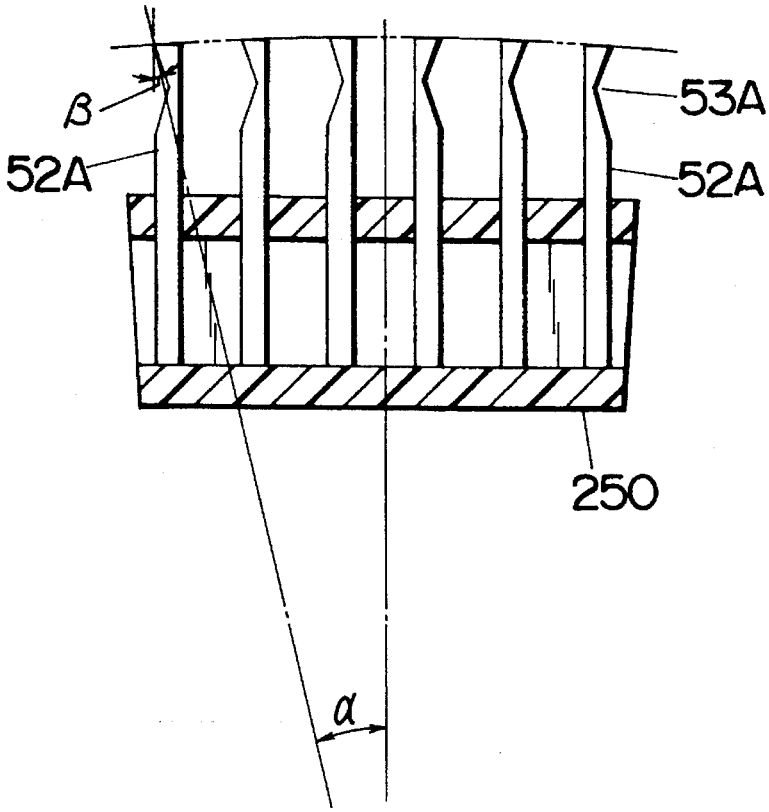

Referring to FIG. 14, there is shown a cutter head in accordance with a second embodiment of the present invention which includes an outer shearing foil 30A of identical configuration to that of the first embodiment but includes a differently configured inner cutter 50A. The inner cutter 50A comprises a like base 51A and a plurality of carriers 250 each carrying a limited number of inner blades 52A. The base 51A is connected to a like drive arm 60A to be driven thereby to reciprocate in shearing engagement with the curved outer shearing foil 30A. Each carrier 250 is made from a plastic material to have a flat bottom and to have the inner blades 52A molded therein. The inner blades 52A are arranged upright in parallel relation to each other and evenly spaced along a length of the carrier 250. As in the previous embodiment, the inner blades 52A offset from a longitudinal center of the carrier 250 are formed to have undercuts 53A in one of the opposite faces directing outwardly in the offset direction so as to form a rake angle $\beta$ with respect to a vertical plane perpendicular to the length of the carrier 250. The base 51A is formed on its top surface with a plurality of inclined seats 251 which are arranged along a general curve of the same curvature as the outer shearing foil 30A. The carriers 250 are secured such as by welding or adhesion to the individual inclined seats 251 such that the inner blades are oriented generally radially from a center of the curvature. After the carriers 250 are mounted on the base 51A with the tips of the blades 52A forming an envelop E, as shown in FIG. 15, the inner blades 52A are ground along a curvature, as indicated by C in the figure, which defines the arcuate contour in conformity with the outer shearing foil 30A, and therefore has a uniform radius of curvature substantially equal to that of the outer shearing foil 30A. Each carrier 250 has the inner blades 52A of identical configuration in which the undercut 53A is so made as to define the rake angle $\beta$ which is greater than an angular displacement $\alpha$ of the cutting edge of the outermost blade 52A along the arcuate contour from the longitudinal center of the carrier 250. Thus, even the outermost blade 52A has at its outwardly directed face a true rake angle $\delta$ with respect to the plane normal to the arcuate contour from the relation $\delta=\beta-\alpha$, as discussed with reference to the first embodiment. This means that all of the blades 52A can have a cutting angle of less than 90°, despite that the inner blades 52A are mounted upright to each of the carrier 250 for easy molding in of the blades 52A. It should be noted in this connection that, with the generally radial arrangement of the blades 52A, all the inner blades 52A of the different carriers 250 can be made to have substantially the same cutting angle for assuring uniform cutting performance over the entire length of the inner cutter.

Figure 17:
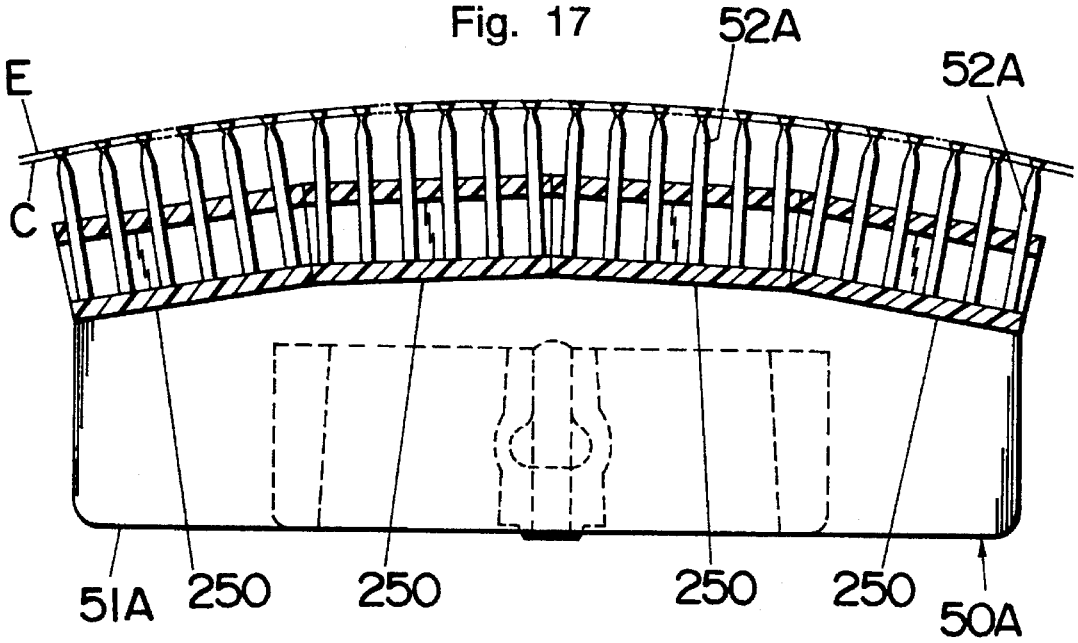
FIG. 17 and 18 are enlarged front sectional views, respectively of an inner cutter and a carrier in accordance with a modification of the embodiment of FIG. 14.
Figure 18:
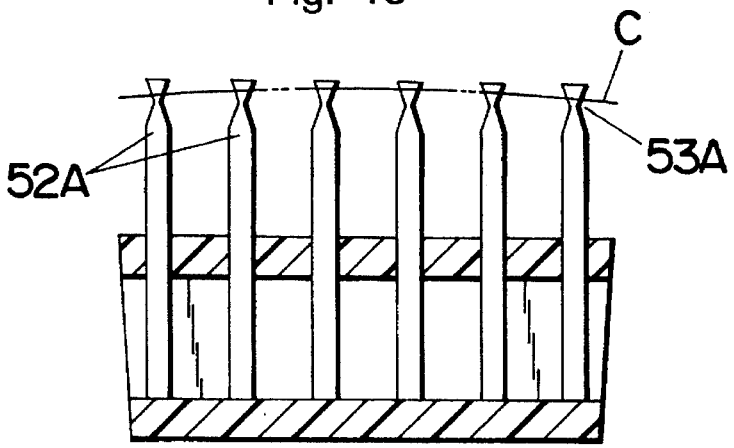

The blades 52A may be formed both in the opposed faces with the like undercut 53A to define a sharper cutting angle at the other face directing inwardly toward the longitudinal center of the carrier 250, as shown in FIGS. 17 and 18. Further, instead of providing the inclined seats on the top of the base 51A, the carriers 250 may be formed to have inclined bottoms so as to be aligned generally along the intended curve for enabling the generally radial disposition of the inner blades.

Figure 19:
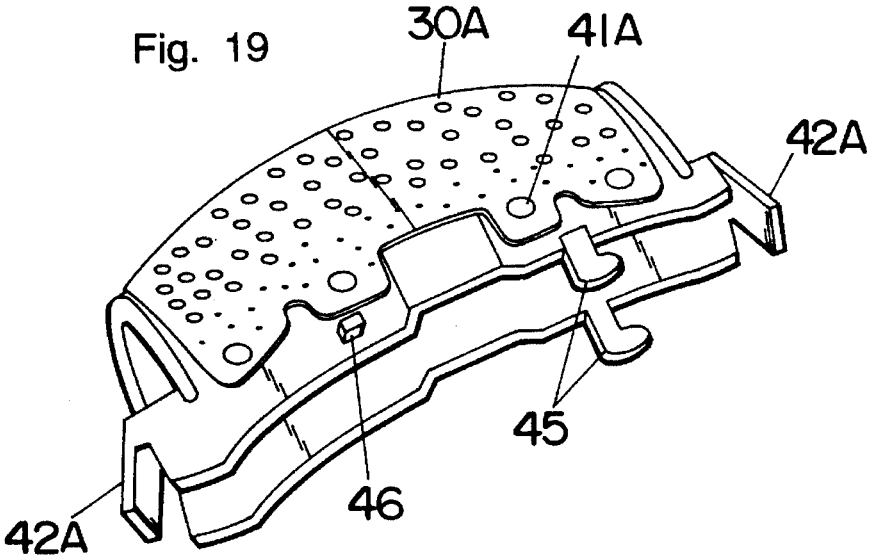
FIG. 19 is a perspective view of an outer shearing foil utilized in the shaver of the above embodiment.

Turning to FIG. 19, a holder 40A of the outer shearing foil 30A is preferred to have downwardly extending fingers 45 and bosses 46 which are formed on opposite sides of the longitudinal center of the holder 40A. The bosses 46 are engaged respectively into vertical grooves 120 correspondingly formed interiorly of the head frame 21, as shown in FIG. 2, in order to keep the outer shearing foil 30A stably in the longitudinal direction but allow the holder 40A to move vertically. The fingers 45 are adapted for use to be readily accessible by a user's finger when detaching outer shearing foil 30A from the head frame 21. For detachment of the outer shearing foil 30A, the user is simply required to engage the fingers and pulling the holder 40A downwards, whereby one of the resilient legs 42A is flexed to permit the other leg 42A to be readily disengaged from the corresponding portion of the head frame, after which the remaining leg is disengaged. Thus, the outer shearing foil can be readily detached.

Figure 20:
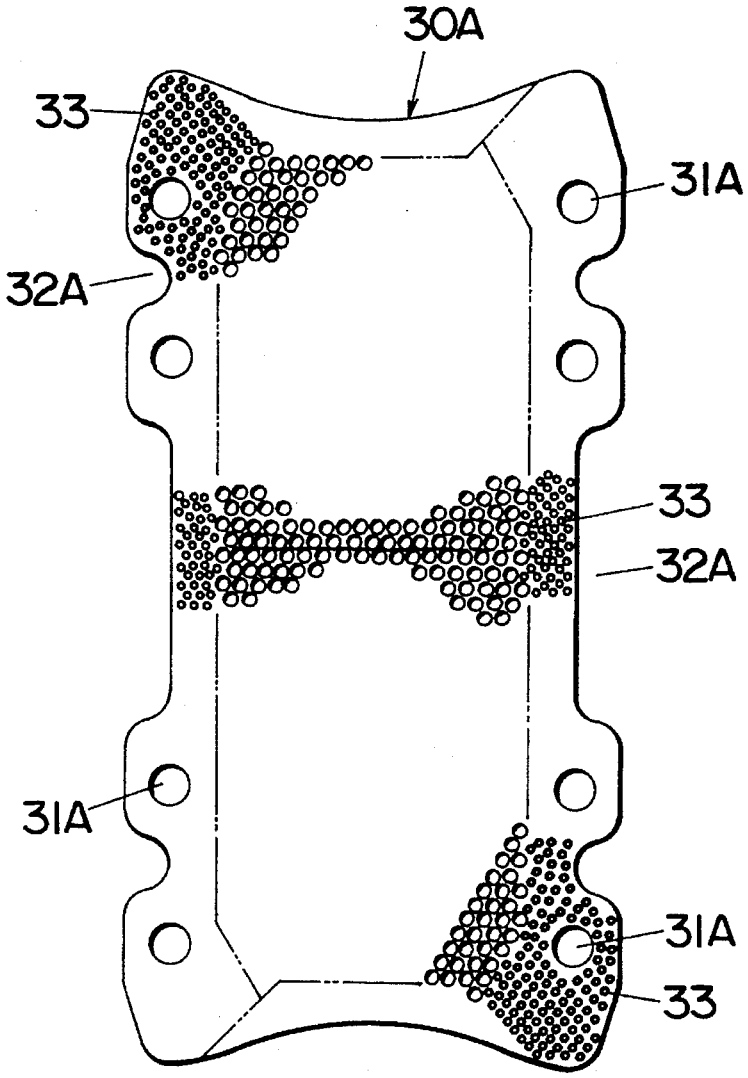
FIG. 20 is a plan view of the outer shearing foil.

FIG. 20 shows the outer shearing foil 30A in its extended condition which has, in addition to a number of hair introducing perforations, cut-outs 32A in lateral sides thereof, and mount holes 31A for attachment to the holder 40A, and further a number of minute holes 33 distributed in the peripheral portion. The outer shearing foil 30A is obtained by electroforming into the intended curved shape. In this respect, the above cut-outs 32A and the minute holes 33 are provided by flowing an electric current of sufficient density to form the peripheral portion having the same thickness as the inner portion with the perforations. Although the cut-outs 32A and the minute holes 33 are illustrated in the figure, it may be equally possible to provide one of the cut-outs 32A and the minute holes 33. As shown in FIGS. 21 and 22, the outer shearing foil 30B may be formed around the mount hole 31B with a sink 34 with increased thickness. That is, by forming a corresponding recess 37 in a pattern 36 on which the outer shearing foil is electroformed, as shown in FIG. 23B, the sink 34 of increased thickness results from a primary plated layer 35, as shown in FIG. 23C. FIG. 23A shows a flat portion of the pattern 36 with a resist 37. In FIGS. 23A to 23C, the pattern 36 is shown with the resist 37 forming the holes, cut-outs, and perforations. As shown in FIGS. 24 and 25, the outer shearing foil 30C may be formed to have a corrugated section 38 in its peripheral portion, in addition to the like cut-outs 32C for reinforcing the peripheral portions to be secured to the holder.

Figure 26:
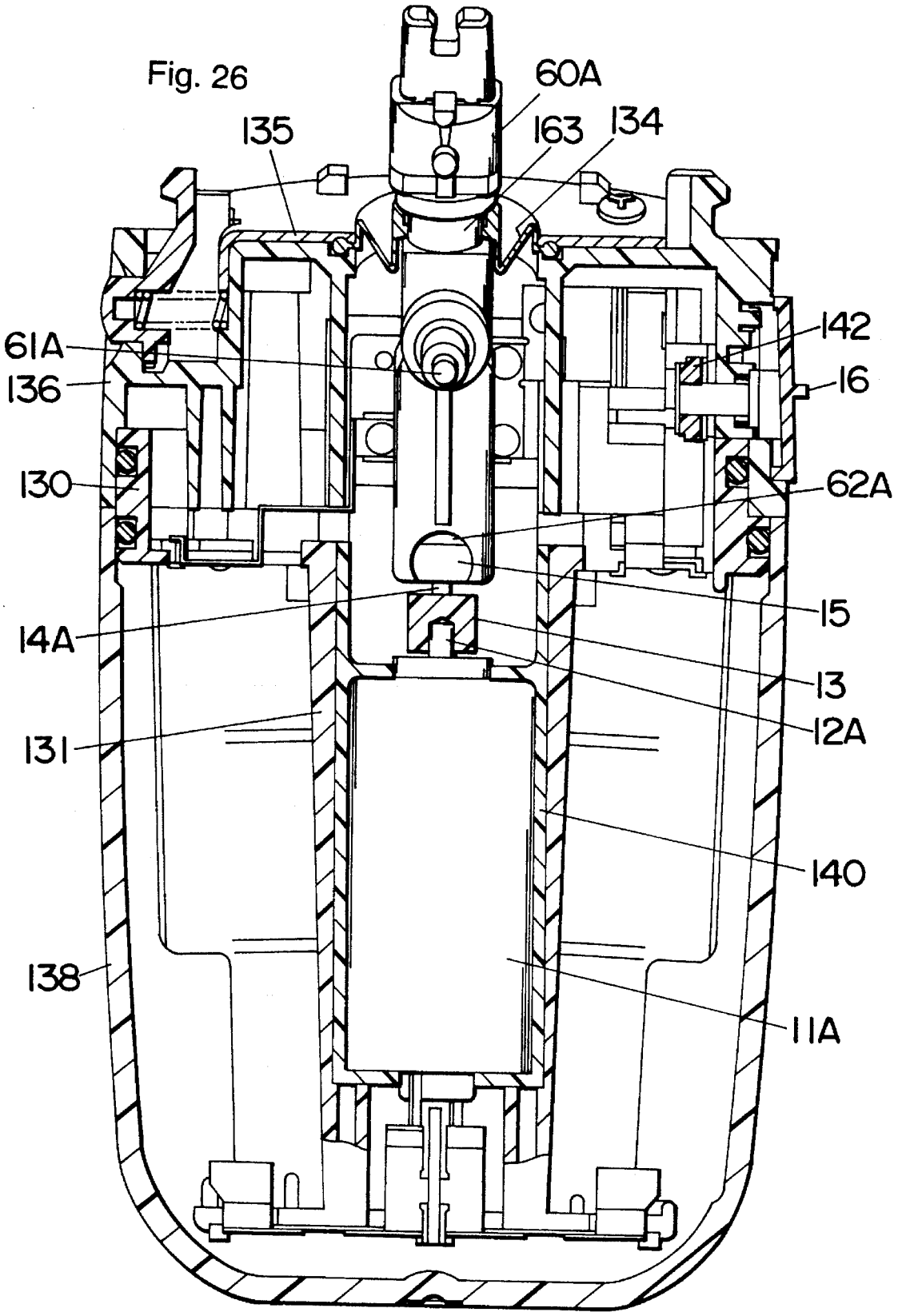
FIG. 26 is a front sectional view of the shaver of the above embodiment with a cutter head removed.
Figure 27:
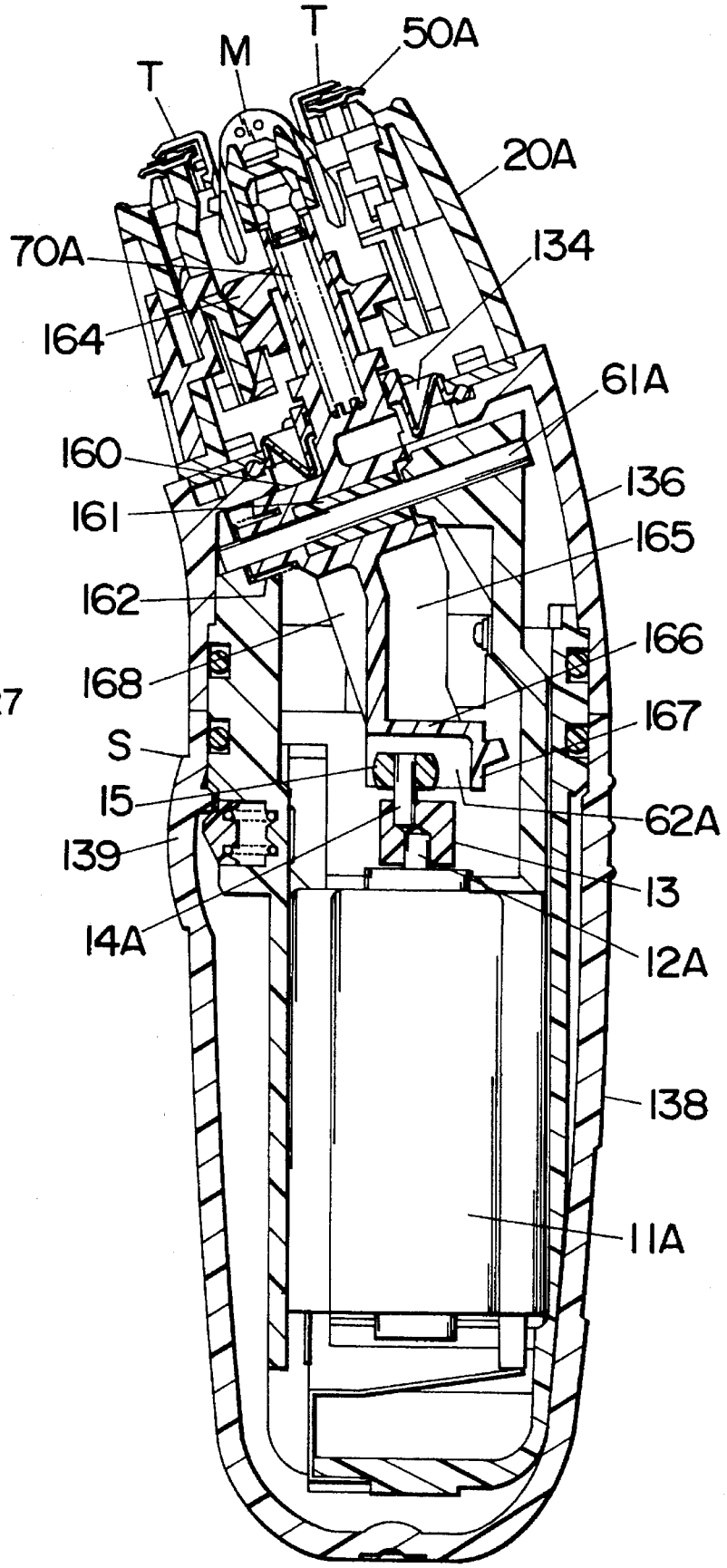
FIG. 27 is a side sectional view of the shaver.
Figure 28:
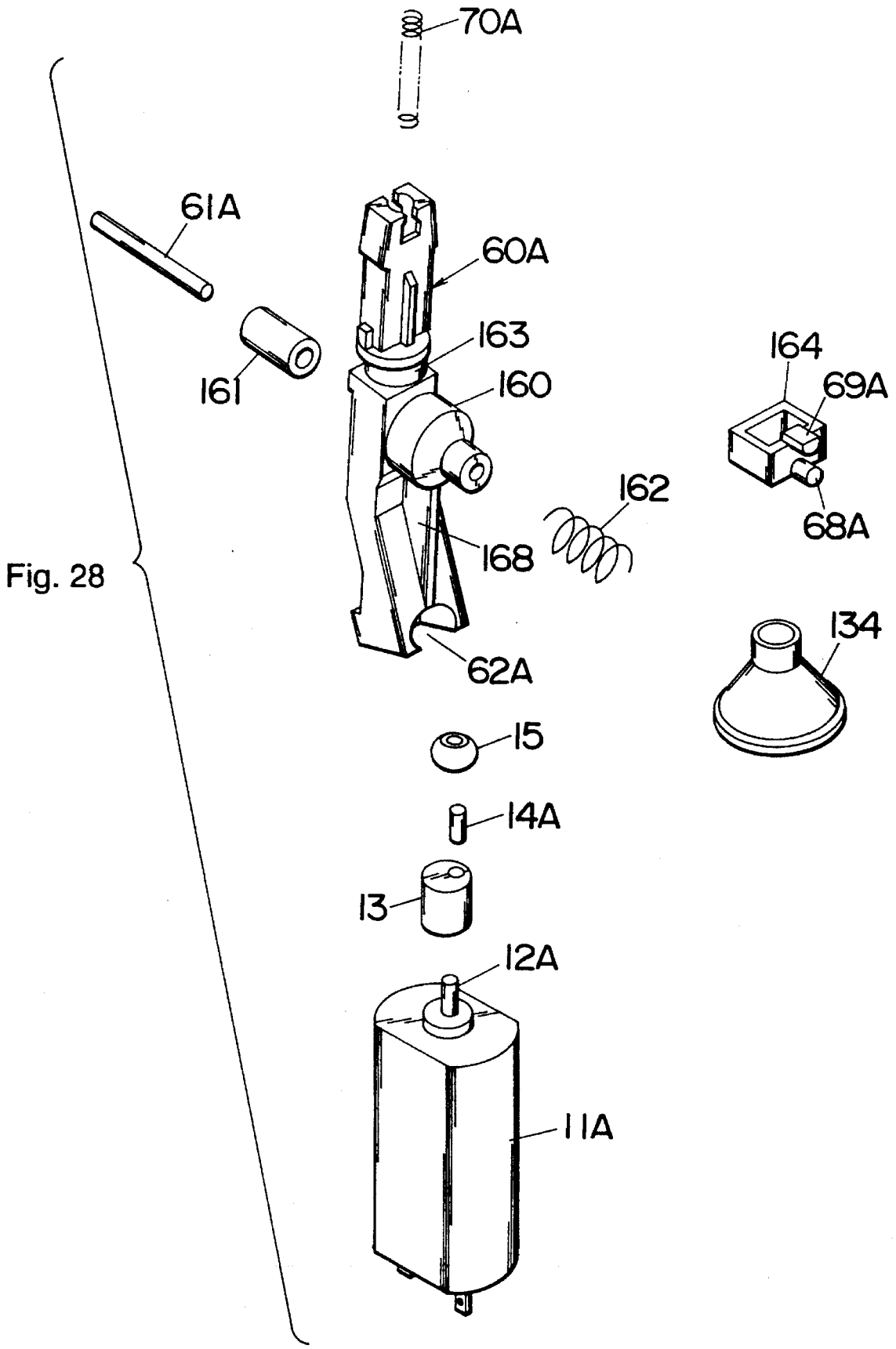
FIG. 28 is an exploded perspective view of a drive arm for reciprocating the inner cutter and associated parts.

FIGS. 26 and 27 illustrate a shaver housing 10A on which the head frame is mounted. The housing 10A comprises a frame 130 which are covered by an upper casing 136 and a lower casing 138. The frame 130 is integrally formed with a top opened center envelop 131 which receives therein a motor holder 140 and carries dry batteries (not shown) on opposite sides of the envelop 131. The motor holder 140 carries the motor 11A, the drive arm 60A, and a switch 142 which is connected to a switch handle 16 on the exterior of the upper casing 136 for turning on and off the motor 11A. The motor holder 140 is inserted in the envelop 131 with the upper end portion of the drive arm 60A projecting upwardly of the upper casing 136. A generally conical seal 134 is fitted around the drive arm 60A for sealing thereof with a top face of the upper casing 136. A retainer plate 135 is mounted on top of the upper casing 136 to fix the lower flared ends of the seal 134 therebetween. The upper end of the seal 134 is fitted in a constriction 163 in the drive arm 60A.

As shown in FIG. 27, the drive arm 60A has its upper half portion inclined with respect to a vertical axis of the housing in alignment with the inclined cutter head 20A, and is pivotally supported by the correspondingly inclined pivot pin 61A. The pivot pin 61A is fixed to the motor holder 140 and extends through a bearing 161 received in a center barrel 160 of the drive arm 60A. A coil spring 162 is inserted around the end of the pivot pin 61A between the center barrel 160 of the drive arm 60A and the interior surface of the upper casing 136 to hold the drive arm 60A stably with respect to the axial direction of the pin 61A for prevent undesired shifting of the drive arm 60A therealong during the operation of reciprocating the inner cutter 50A.

Figure 29A:
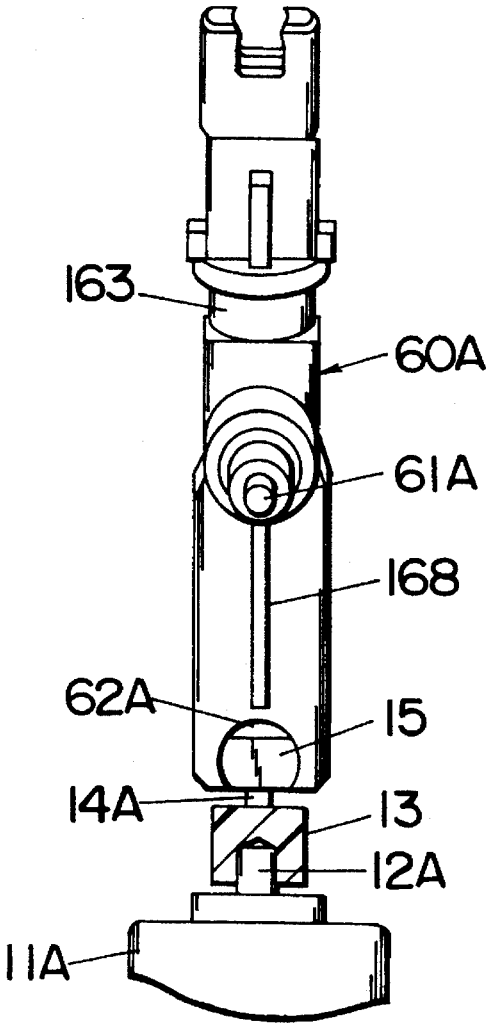
FIGS. 29A and 29B are views respectively illustrating operation of the drive arm at engagement with an eccentric cam rotating by a motor.
Figure 29B:
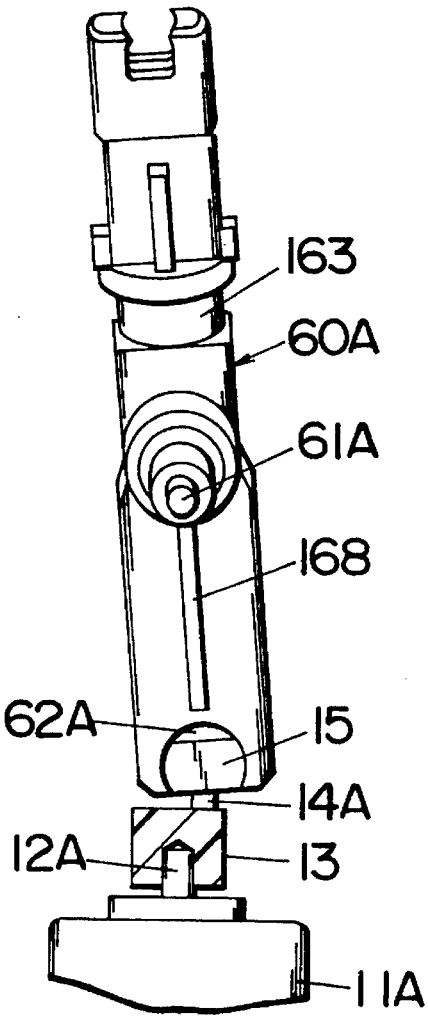

The drive arm 60A is connected at its bottom with the motor 11A through a cam coupling including a cam wheel 15 having a partially spherical outer surface. The cam wheel 15 is rotatably supported on an eccentric pin 14A on a balancer 13 connected to an output shaft 12A of the motor 11A in an eccentric relation thereto. The cam wheel 15 is received in a rounded slot 62A formed in the lower end of the drive arm 60A as a cam follower so that the eccentric motion of the cam wheel 15 around the output shaft 12A is converted into an oscillating motion of the drive arm 60A about the pivot pin 61A for reciprocating the inner cutter 50A during which the cam wheel 15 is guided along the length of the rounded slot 62A or in the direction perpendicular to the axis of the output shaft 12A and which is allowed to roll to some extent due to a rolling contact between the cam wheel 15 and the rounded interior of the slot 62A, as shown in FIGS. 29A and 29B, for smoothly oscillating the drive arm 60A about the pivot pin 61A. Since the cam wheel 15 and the rounded slot 62A has the rounded periphery having substantially the same radius, the cam wheel 15 can be in contact with the interior of the slot 62A with a minimum friction, thereby minimizing wearing at the connection of the cam wheel and the slot for prolonged operational life. Fitted around the drive arm 60A above the constriction 163 is a ring 164 with drive pins 68A and 69A which are selectively connected to drive the trimmer T.

In order to reduce a mass of the drive arm 60A while giving a sufficient mechanical strength thereto, the drive arm 60A is shaped to have a cut-out 165 extending along the length of the drive arm 60A from the center barrel 160 to the slot 62A, as best shown in FIG. 27, so that the drive arm 60A has a generally U-shaped cross-section, as shown in FIG. 32B, along that portion. The cut-out 165 is separated from the slot 62A by a partition 166 from one end of which an end wall 176 extends to close one longitudinal end of the slot 62A. The partition 166 and the end wall 167 are cooperative to impart rigidity to the coupling end of the drive arm 60A to the cam wheel 15. Further, the drive arm 60A is formed on the surface of the drive arm 60A opposite of the cut-out 165 with a rib 168 extending longitudinally from the center barrel 160 to the lower end adjacent to the slot 62A so as to give sufficient rigidity to the drive arm as well as the coupling end thereof for resisting undesired twisting force being applied thereto.

Figure 33B:
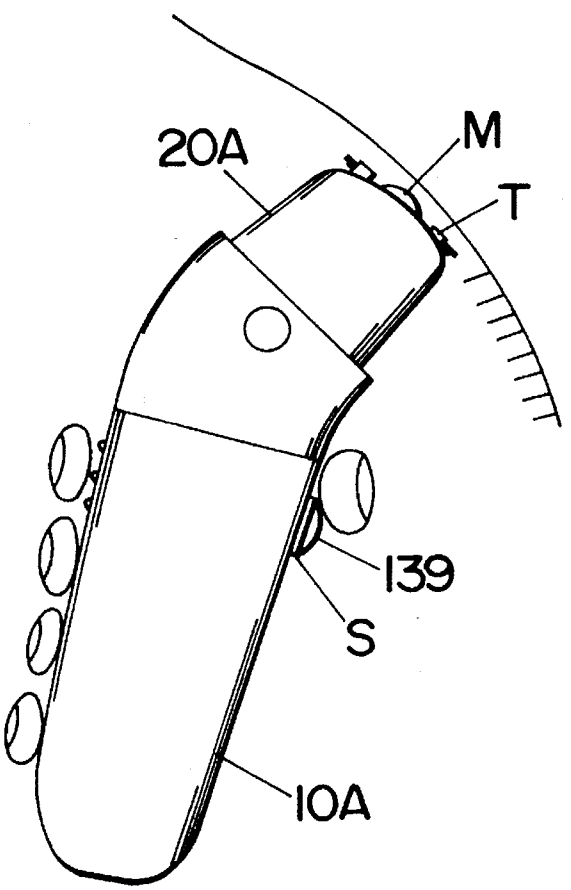
FIG. 33A and 33B are schematic views respectively illustrating operations of moving the dry shaver across a user's skin.
Figure 33A:
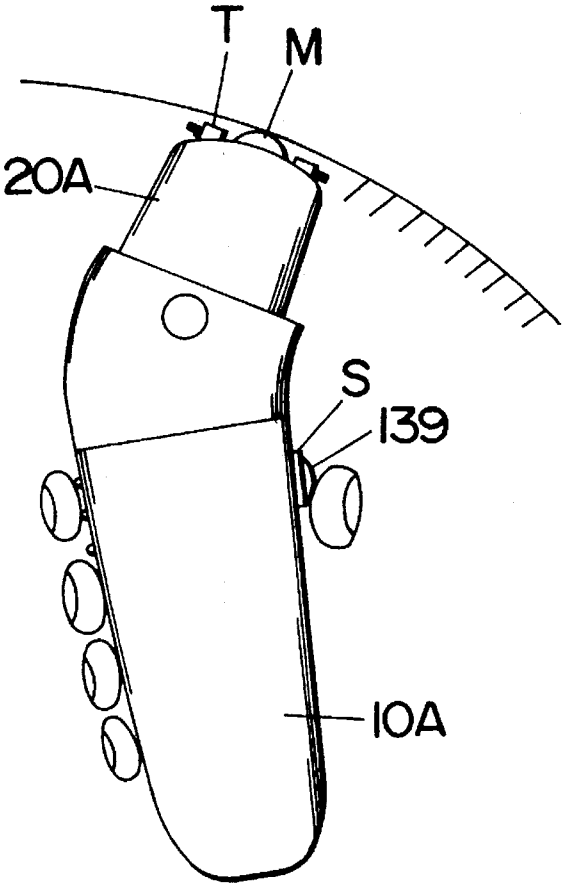

The housing 10A or the lower casing 138 is formed with a rounded projection 139 in its front face which forms a concave configuration with the inclined cutter head 20A. The projection 139 has a top rounded surfaced projecting adjacent to a plane passing through the lower end of the front face and the upper end of the cutter head 20A. Preferably, the top surface of the projection 139 projects beyond a plane passing through the lower end of the front face and the cutting edge of the extended trimmer T on the front of the cutter head 20A so that, when the shaver is placed on a table or a like supporting surface with its front face down, the cutting edge of the trimmer is kept out of contact with a supporting surface. The projection 139 defines around its periphery an edged step S, as shown in FIGS. 33A and 33B, for firm engagement with a thumb of the user's hand grasping the shaver. The housing 10A is formed on its rear face with knurled portion for engagement with the finger of the user's hand. During the operation of moving the cutter head 20A across the user's skin, the user may easily to manipulate, i.e., rotate and angle the shaver with the thumb kept engaged with the edged step S of the projection 139 for guiding the cutter head across concave or convex portion of the user's skin.

What is claimed is:

1. A dry shaver which comprises:

a perforated outer shearing foil having a first axis and curved arcuately along said first axis to have a uniform curvature;

an inner cutter having a longitudinal axis and having an arcuate contour curved along said longitudinal axis in conformity with the first axis of said outer shearing foil;

drive means for reciprocating said inner cutter along a reciprocation path parallel to said first axis in hair shearing engagement with said outer shearing foil;

said inner cutter comprising a plurality of inner blades which are spaced along said longitudinal axis in parallel relation to each other, each of said blades having opposed first and second faces each defining a cutting edge at its upper end, the individual cutting edges of said inner blades lying in an arcuate path to define said arcuate contour, each of said blades, of said inner cutter being positioned with said first face directed outwardly with respect to a longitudinal center of said inner cutter, with an undercut in said first face immediately adjacent to said cutting edge, said undercut cooperating with an adjacent cutting edge to give a first rake angle $\beta$ with respect to a vertical plane as well as to give a true rake angle $\delta$, said true rake angle $\delta$ being measured with respect to a plane normal to a tangent of the arcuate contour of said inner cutter at the contact between said adjacent cutting edge and said outer shearing foil so as to make the cutting edge angle defined between said true rake angle $\delta$ and said tangent to be of less than 90°.

2. A dry shaver as set forth in claim 1, wherein all of the inner blades have a common first rake angle $\beta$ and the inner blade at each of the opposed longitudinal ends of said inner cutter has said common first rake angle $\beta$ which is greater than an angular displacement $\alpha$ between the cutting edge and the longitudinal center of said inner cutter along said arcuate contour of said inner cutter, said angular displacement $\alpha$ increasing with an increasing longitudinal distance outward from said longitudinal center.

3. A dry shaver as set forth in claim 1, wherein said inner cutter includes a pair of additional inner blades which are disposed longitudinally outwardly of a remainder of said inner blades, respectively, each blade of said additional pair of inner blades having opposed faces, each defining a cutting edge at its upper end which is aligned on said arcuate contour, each blade of said additional pair of inner blade having one of its opposed faces directed longitudinally outward of said inner cutter with a cutting angle of more than 90°.

4. A dry shaver as set forth in claim 1, wherein said inner cutter includes a pair of additional inner blades which are disposed longitudinally outwardly of a remainder of said inner blades, respectively, each blade of said additional pair of inner blades having opposed faces, each defining a cutting edge at its upper end which is aligned on said arcuate contour, each said additional inner blade having one of its opposed faces directed longitudinally outwardly of said inner cutter with an additional undercut adjacent to said cutting edge so as to form a cutting angle of more than 90°.

5. A dry shaver as set forth in claim 1, wherein the second face of each of said inner blades is formed with an undercut which defines an arcuate rake angle with the adjacent cutting edge.

6. A dry shaver which comprises:

a perforated outer shearing foil having a first axis and curved arcuately along said first axis to have a uniform curvature;

an inner cutter having a longitudinal axis and having a generally arcuate contour curved along said longitudinal axis in conformity with the first axis of said outer shearing foil;

drive means for reciprocating said inner cutter along a reciprocation path parallel to said first axis in hair shearing engagement with said outer shearing foil;

said inner cutter comprising a single base and a plurality of carriers each mounting a plurality of inner blades in parallel relation to one another and upstanding from its respective carrier, said carriers being arranged on said base along an arcuate path corresponding to said curvature of said outer shearing foil so that said inner blades are oriented generally radially from a center of the curvature, each of said inner blades having opposed first and second faces, each face defining a cutting edge at its upper end, each of said blades being positioned in its respective carrier with said first face directed outwardly with respect to a longitudinal center of said carrier and each of said blades being formed in at least one of said first and second faces with an undercut immediately adjacent to said cutting edge, said undercut forming an angle with its adjacent cutting edge to give a rake angle of less than 90°.

7. A dry shaver as set forth in claim 6, wherein, the inner blades on each of said carriers are formed to define an arcuate contour in exact conformity with said curvature for said outer shearing foil.

8. A dry shaver which comprises:

a perforated outer shearing foil having a first axis and curved arcuately along said first axis to have a uniform curvature;

an inner cutter having a longitudinal axis and having a generally arcuate contour curved along said longitudinal axis in conformity with the first axis of said outer shearing foil;

drive means for reciprocating said inner cutter along a reciprocation path parallel to said first axis in hair shearing engagement with said outer shearing foil;

said inner cutter comprising a single base and a plurality of carriers each mounting a plurality of inner blades in parallel relation to one another and upstanding from its respective carrier, said carriers being arranged on said base along an arcuate path corresponding to said curvature of said outer shearing foil so that said inner blades are oriented generally radially from a center of the curvature each of said inner blades having opposed first and second faces each face defining a cutting edge at its upper end, each of said blades being positioned in its respective carrier with said first face directed outwardly with respect to a longitudinal center of said carrier and each of said blades being formed in each one of said first and second faces with an undercut immediately adjacent to said cutting edge, said undercut forming an angle with its adjacent cutting edge to give a rake angle of less than 90°.

* * * * *